US008840104B2

(12) United States Patent
Fujikake

(10) Patent No.: US 8,840,104 B2
(45) Date of Patent: Sep. 23, 2014

(54) PRINTING APPARATUS AND SHEET HANDLING APPARATUS

(75) Inventor: Akira Fujikake, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 66 days.

(21) Appl. No.: 13/370,122

(22) Filed: Feb. 9, 2012

(65) Prior Publication Data

US 2012/0205483 A1 Aug. 16, 2012

(30) Foreign Application Priority Data

Feb. 14, 2011 (JP) ..... 2011-028824

(51) Int. Cl.

| | |
|---|---|
| ***B65H 29/68*** | (2006.01) |
| ***B41J 15/16*** | (2006.01) |
| ***B41J 3/60*** | (2006.01) |
| ***B65H 29/00*** | (2006.01) |

(52) U.S. Cl.

CPC ..... *B41J 15/16* (2013.01); *B65H 2801/15* (2013.01); *B65H 2301/132* (2013.01); *B65H 2301/4193* (2013.01); *B65H 2301/414225* (2013.01); *B65H 2301/4165* (2013.01); *B65H 2301/12* (2013.01); *B41J 3/60* (2013.01); *B65H 29/008* (2013.01)

USPC ..... 271/69; 271/186; 271/291

(58) Field of Classification Search

USPC ..... 271/69, 186, 291

See application file for complete search history.

(56) References Cited

U.S. PATENT DOCUMENTS

| | | | | |
|---|---|---|---|---|
| 6,522,860 | B2 * | 2/2003 | Nose et al. | 399/374 |
| 6,631,900 | B2 * | 10/2003 | Salgado | 271/186 |
| 2003/0132571 | A1 * | 7/2003 | Salgado | 271/186 |

FOREIGN PATENT DOCUMENTS

JP 2008-126530 A 6/2008

* cited by examiner

*Primary Examiner* — David H Bollinger

(74) *Attorney, Agent, or Firm* — Canon USA, Inc. IP Division

(57) ABSTRACT

A sheet conveyance apparatus for winding a sheet around a rotator, pulling the sheet wound around the rotator, and sending out the sheet includes a guiding unit that guides a sheet side end pulled from the rotator. The guiding unit forms a slack in the outer periphery of the sheet wound around the rotator, and guides the side end of the sheet sent from the rotator.

16 Claims, 19 Drawing Sheets

PRINTING APPARATUS AND SHEET HANDLING APPARATUS

BACKGROUND OF THE INVENTION

1. Field of the Invention

The present invention relates to a printing apparatus for recording on a continuous sheet.

2. Description of the Related Art

Japanese Patent Application Laid-Open No. 2008-126530 discusses a printing apparatus for performing two-sided printing on the front-side and the back-side of a continuous sheet by inkjet printing, which is long and wound in a rolled state. The apparatus rewinds the sheet around a rotator (second roll) once and a printing unit performs printing on the front-side of the sheet. Then, the apparatus inverts the front-side, conveys the sheet to the printing unit again, and printing is performed on the back-side.

In the apparatus discussed in Japanese Patent Application Laid-Open No. 2008-126530, if the sheet is introduced in a slanting direction (if a skew occurs) at the time of winding the sheet around the rotator, the sheet may be wound around the rotator in the slanting state. When the sheet wound in such a slanting state is sent to the printing unit again, the printing position on the back-side in the sheet width direction becomes incorrect. As a result, accurate positioning of the front-side image and the rear surface image becomes difficult.

Consequently, the apparatus cannot perform high-quality two-sided printing. Japanese Patent Application Laid-Open No. 2008-126530 does not specifically discuss the problem, and provides no solution to the problem.

SUMMARY OF THE INVENTION

The present invention is directed to provide a printing apparatus and a sheet handling apparatus capable of reducing a skew generated in a sheet sent from a rotator.

According to an aspect of the present invention, a printing apparatus for winding a sheet around a rotator and, sending out the sheet wound around the rotator, includes a guiding unit configured to guide a side end of the sheet pulled from the rotator. The guiding unit forms a slack in the outer periphery of the sheet wound around the rotator, and guides the sheet side end sent out from the rotator.

According to the exemplary embodiment of the present invention, the conveyance apparatus capable of reducing the skew generated in the sheet sent from the rotator can be provided.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute apart of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Hereinafter, an exemplary embodiment of a printing apparatus employing an inkjet method is described. The printing apparatus according to the exemplary embodiment is a high-speed line printer that can perform one-sided printing or two-sided printing using a long continuous sheet. The sheet is a continuous sheet longer than the length of one print unit (one page or one unit image) that is to be repeated in the conveyance direction. The printing apparatus is suitably used, for example, in the field of printing of a large number of sheets such as printing in print laboratories. In the present specification, one unit image means contents included in a print unit (one page) even if a plurality of small images, characters, or spaces are included. In other words, the unit image means a print unit (one page) in sequentially printing a plurality of pages on the continuous sheet. Depending on the image size to be printed, the length of the unit image differs. For example, in a case of a picture of the L-size, the length of the picture in the sheet conveyance direction is 135 mm. In a case of a picture of the A4 size, the length of the picture in the sheet conveyance direction is 297 mm.

The present invention can be widely applied to printing apparatuses such as printers, multifunction peripherals, facsimile machines, and manufacturing apparatuses of various devices. The print processing method includes inkjet methods, electrophotographic methods, heat transfer methods, dot impact methods, and liquid development methods. The present invention can be applied to sheet processing apparatuses for performing not only print processing but also various kinds of processing such as recording, product working, coating, exposure, reading, tests, on a rolled sheet.

Figure 1:
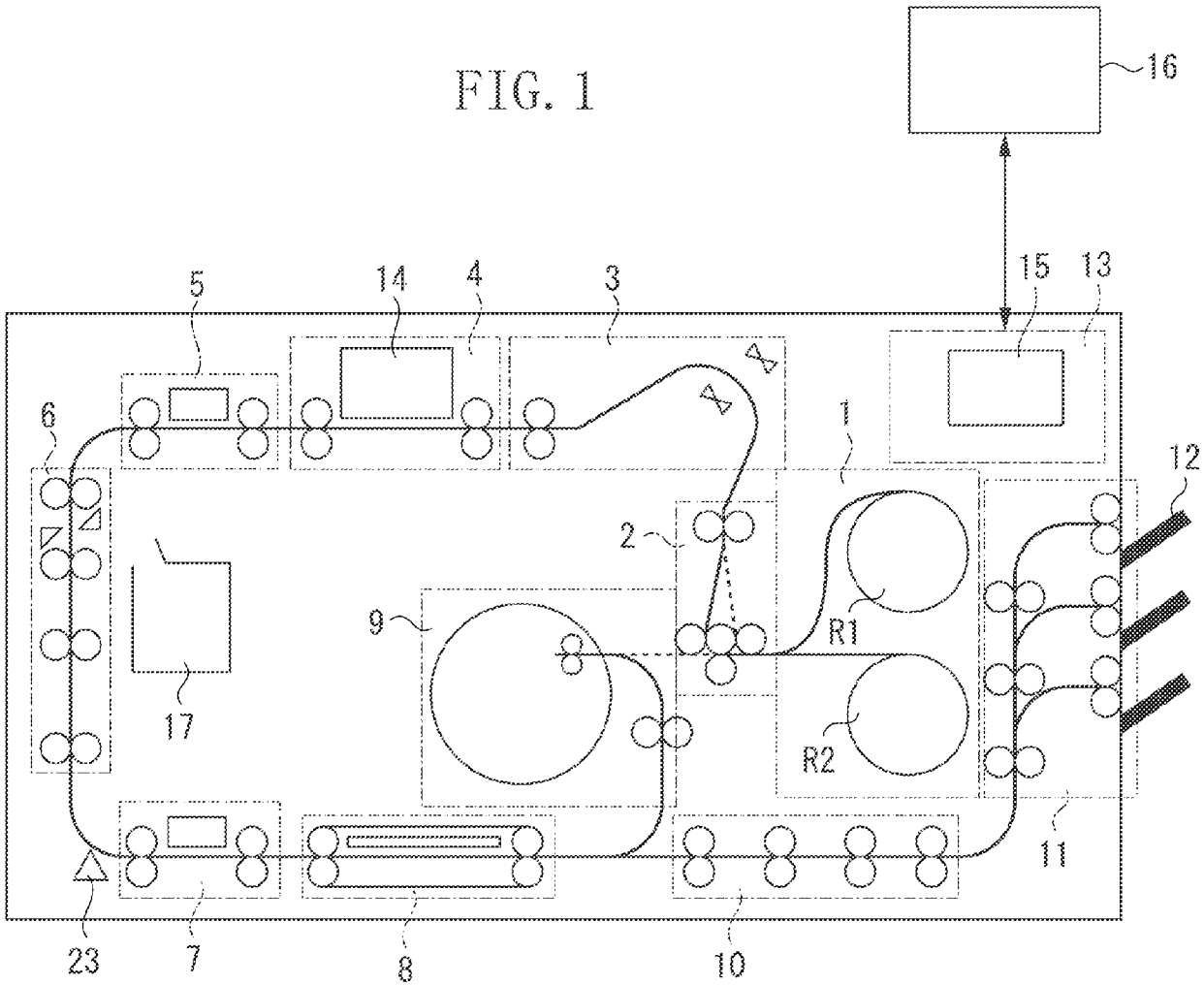
FIG. 1 is a schematic view illustrating an internal configuration of a printing apparatus.

FIG. 1 is a schematic view illustrating the cross-section of an internal configuration of a printing apparatus. The printing apparatus according to the exemplary embodiment can print on both of the first surface of the sheet and the second surface of the sheet. The sheet is wound in a rolled state, and the second surface is the back-side of the first surface. The printing apparatus, as main units, includes a sheet supplying unit 1, a decurling unit 2, a skew correction unit 3, a printing unit 4, an inspection unit 5, a cutter unit 6, an information recording unit 7, a drying unit 8, a reversing unit 9, a discharge and conveyance unit 10, a sorting unit 11, a discharge unit 12, and a control unit 13 The sheet is conveyed by a conveyance mechanism including a pair of rollers and a belt along the sheet conveyance path illustrated by the solid line in the drawing, and processed in each unit. At a point in the sheet conveyance path, the side closer to the sheet supplying unit 1 is referred to as "upstream", and the other side is referred to as "downstream".

The sheet supplying unit 1 holds and supplies the continuous sheet that is wound in the rolled state. The sheet supplying unit 1 can store two rolls of a roll R1 and a roll R2. The sheet supplying unit 1 selectively pulls and supplies the sheet. The sheet supplying unit 1 can store not only two rolls, but can store one or more than two rolls. As long as the sheet is continuous, any sheet other than the sheet wound in the rolled state can also be used. For example, a continuous sheet on which lines of perforation of a unit length are formed, being folded and laminated at each line, can be stored in the sheet supplying unit 1.

The decurling unit 2 reduces curl (warpage) of the sheet supplied from the sheet supplying unit 1. The decurling unit 2 reduces the curl by passing the sheet through the unit such that the curl is curved in the direction opposite to one drive roller using two pinch rollers, and as a result, a decurling force is applied to the sheet. As will be described below, the decurling unit 2 can adjust the decurling force.

The skew correction unit 3 corrects skew (a tilt to the original travelling direction) of the sheet that has passed through the decurling unit 2. The skew correction unit 3 pushes the sheet end part of a reference side against a guiding member to correct the skew of the sheet.

The printing unit 4 performs print processing on the conveyed sheet from above with a print head 14 to form an image. In other words, the printing unit 4 serves as a processing unit for performing a predetermined processing on the sheet. The printing unit 4 includes a plurality of conveyance rollers for conveying the sheet. The print head 14 includes a line-type print head on which inkjet-type nozzle arrays are formed such that the nozzle arrays cover a maximum width of sheets expected to be used. In the apparatus, a plurality of the print heads 14 is arranged in parallel along the conveyance direction. In the exemplary embodiment, the printing apparatus includes seven print heads corresponding to seven colors of cyan (C), magenta (M), yellow (Y), light cyan (LC), light magenta (LM), gray (G), and black (B). The number of colors and the number of print heads are not limited to seven.

As the inkjet method, a method using a heating element, a piezoelectric element, an electrostatic element, a Micro Electro Mechanical System (MEMS) element, or the like can be employed. The ink of the individual colors is supplied from individual ink tanks through individual ink tubes to the print heads 14. As will be described below, in the printing unit 4, the print heads 14 can move in a direction retracting from the sheet. By using this mechanism, the space between the sheet and the print heads 14 can be adjusted.

The inspection unit 5 optically reads an inspection pattern or an image printed on the sheet printed by the printing unit 4, using a scanner. Further, the inspection unit 5 inspects the state of the nozzles of the print heads, the sheet conveyance state, the image positioning, and the like to determine whether the image is appropriately printed. The scanner includes a charge coupled device (CCD) image sensor or a complementary metal-oxide semiconductor (CMOS) image sensor.

The cutter unit 6 includes a mechanical cutter for cutting the printed sheet into a predetermined length. The cutter unit 6 also includes a plurality of conveyance rollers for conveying the sheet to the next process. Near the cutter unit 6, a trash box 17 is provided. The trash box 17 keeps small sheet pieces which are cut off by the cutter unit 6 and discharged as dust. The cutter unit 6 includes a sorting mechanism for sorting the cut sheets as a sheet to be discharged to the trash box 17 or a sheet to be conveyed to the original conveyance path.

The information recording unit 7 records print information (unique information) such as a serial number, date, or the like of the printing onto a region on the cut sheet where the printing is not performed. The recording is performed by printing characters or codes using an inkjet method, a heat transfer method, or the like. At a position on an upstream side of the information recording unit 7 and a downstream side of the cutter unit 6, a sensor 23 is provided. The sensor 23 detects the leading edge of the cut sheet. In other words, the sensor 23 detects the edge part of the sheet at a position between the cutter unit 6 and the recording position where the information recording unit 7 performs recording. Using the timing detected by the sensor 23, the timing for recording the information with the information recording unit 7 is controlled.

The drying unit 8 heats the sheet printed by the printing unit 4 to dry the applied ink in a short time. In the drying unit 8, against the passing sheet, at least from the lower surface, heated air is applied to dry the ink carrying surface. The drying method is not limited to the method of applying the heated air. A method of applying an electromagnetic wave (ultraviolet light, infrared light, or the like) on the sheet surface can also be employed.

The above-described sheet conveyance path from the sheet supplying unit 1 to the drying unit 8 is referred to as a first path. The first path has a shape in which the path U-turns between the printing unit 4 and the drying unit 8. The cutter unit 6 is positioned in the middle of the U-turn shape.

The reversing unit 9, in two-sided printing, temporarily winds the continuous sheet on which the printing on the front-side is finished, and inverts the front-side of the sheet to turn into the back-side. The reversing unit 9 is provided in the middle of a path (loop path) (referred to as a second path) that conveys the sheet from the drying unit 8 via the decurling unit 2 to the printing unit 4. The second path is for supplying the sheet passed through the drying unit 8 to the printing unit 4 again. The reversing unit 9 includes a rotary winding member (drum or rotator) for winding and storing the sheet. The continuous sheet on the front-side of which the printing is finished and not yet cut is temporarily wound around the rotary winding member, and stored. When the winding operation is completed, the rotary winding member reversely rotates to supply the wound sheet to the decurling unit 2, thereby the sheet is sent to the printing unit 4. Since the surface of the sheet is inverted, the printing unit 4 can print on the back-side. More specific operation in the two-sided printing is described below.

The discharge and conveyance unit 10 conveys the sheet that is cut by the cutter unit 6 and dried by the drying unit 8 to hand the sheet to the sorting unit 11. The discharge and conveyance unit 10 is provided in a path (referred to as a third path) different from the second path in which the reversing unit 9 is provided. In order to selectively guide the sheet conveyed through the first path to one of the second path or the third path, the printing apparatus includes a path switching mechanism having a movable flapper at a branch point in the path.

The sorting unit 11 and the discharge unit 12 are provided at the side of the sheet supplying unit 1 and at a terminal part of the third path. The sorting unit 11 sorts the printed sheets into groups as necessary. The sorted sheets are discharged to the discharge unit 12. The discharge unit 12 includes a plurality of trays. As described above, the third path is laid out such that the sheet passes under the sheet supplying unit 1, and the sheet is discharged to the side opposite to the printing unit 4 and the drying unit 8 across the sheet supplying unit 1.

The control unit 13 controls individual units in the printing apparatus. The control unit 13 includes a central processing unit (CPU), a controller having various control units, an external interface, and an operation unit 15. The operation unit 15 is operated by a user to input or output data. The operation of the printing apparatus is controlled according to an instruction from a host device 16 that is directly connected, or connected via the external interface to the controller.

Figure 2:
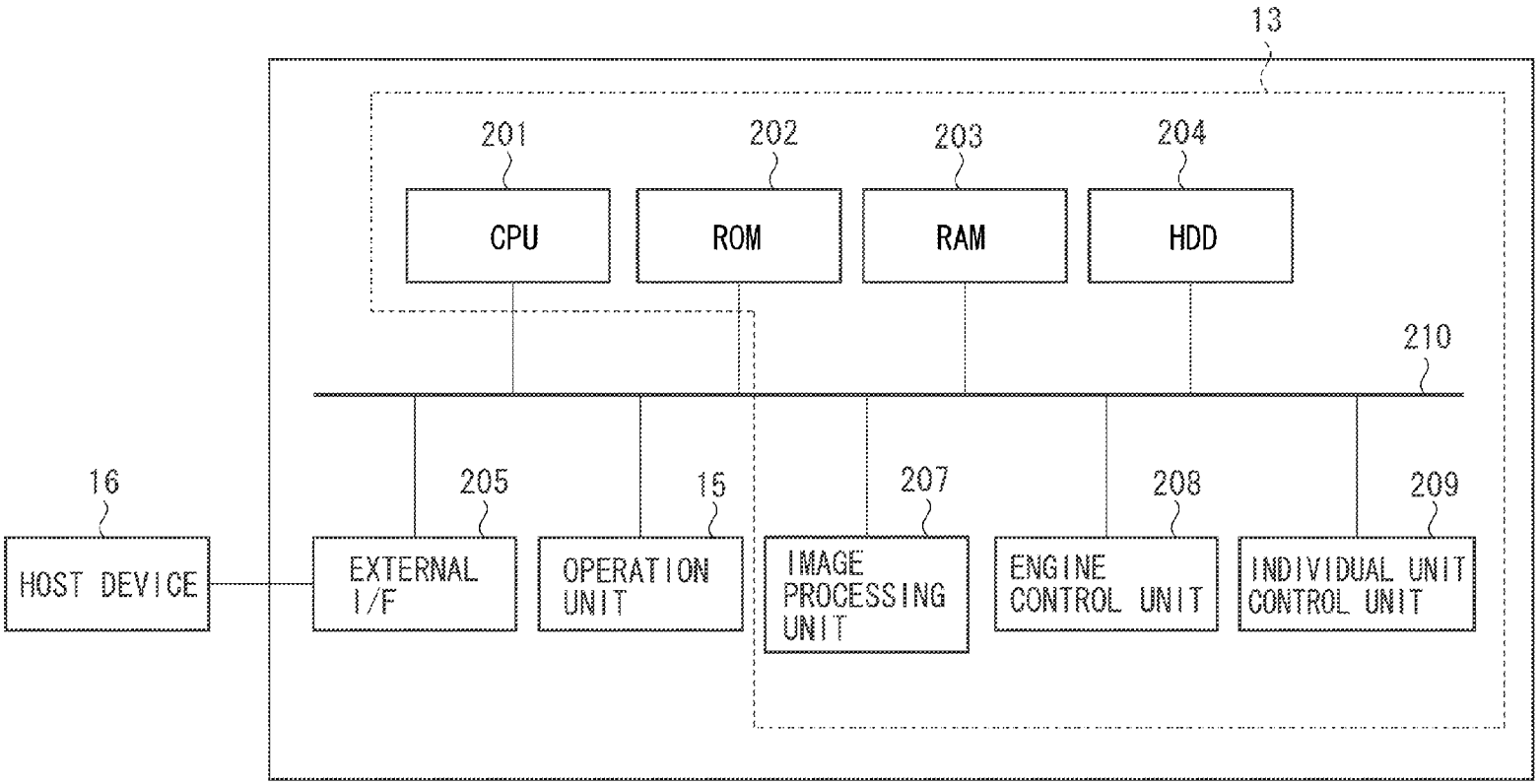
FIG. 2 is a block diagram illustrating a control unit.

FIG. 2 is a block diagram illustrating a concept of the control unit 13. The controllers (units within the dashed line) within the control unit 13 include a CPU 201, a read-only memory (ROM) 202, a random access memory (RAM) 203, a hard disk drive (HDD) 204, an image processing unit 207, an engine control unit 208, an individual unit control unit 209. The CPU 201 performs overall control of operation of the individual units in the printing apparatus. The ROM 202 stores a program to be executed by the CPU 201, and fixed data necessary for various types of operation in the printing apparatus. The RAM 203 can be used for a work area for the CPU 201, a temporary storage region of various kinds of reception data, a region for storing various kinds of setting data, or the like. The HDD 204 can store and read the program to be executed by the CPU 201, print data, and setting information necessary for various kinds of operation in the printing apparatus. The operation unit 15 serves as an interface for inputting or outputting data for a user. The operation unit 15 includes an input unit for a hard key or a touch panel, and an output unit for presenting information, for example, a display device or a voice generation unit.

A dedicated processing unit is provided for a unit that is required to process data at a high speed. The image processing unit 207 performs image processing of print data that is handled in the printing apparatus. The image processing unit 207 converts a color space (for example, YCbCr) of input image data into a standard RGB color space (for example, sRGB). Further, the image processing unit 207 performs various image processing such as resolution conversion, image analysis, or image correction to the image data as necessary. The print data acquired by the above-mentioned image processing is stored in the RAM 203 or the HDD 204. The engine control unit 208 controls drive of the print heads 14 in the printing unit 4 according to a control command received from the CPU 201, or the like and based on the print data. The engine control unit 208 further controls conveyance mechanisms in the individual units in the printing apparatus. The individual unit control unit 209 serves as a subcontroller for individually controls the sheet supplying unit 1, the decurling unit 2, the skew correction unit 3, the inspection unit 5, the cutter unit 6, the information recording unit 7, the drying unit 8, the reversing unit 9, the discharge and conveyance unit 10, the sorter unit 11, and the discharge unit 12. According to an instruction from the CPU 201, the individual unit control unit 209 controls operation of the individual units. The external interface 205 is an interface (I/F) for connecting the controllers to the host device 16. The external interface 205 can be a local I/F or a network I/F. The above-described elements are interconnected by a system bus 210.

The host device 16 serves as a source for supplying data to instruct the printing unit to print an image. The host device 16 can be a general-purpose computer, a dedicated computer, or a special imaging device such as an image capturing device having an image reader, a digital camera, or a photo storage. In a case where the host device 16 is a computer, in a storage device included in the computer, an operating system (OS), application software for generating image data, a printer driver for the printing apparatus are to be installed. It is not always necessary to implement all of the above-described processing by software, a part of, or the all of the processing can be implemented by hardware.

Next, basic operation in printing is described. The printing apparatus operates differently in the one-sided print mode and the two-sided print mode. The operation in the two printing modes will be described respectively.

<One-sided Print Mode>

Figure 3A:
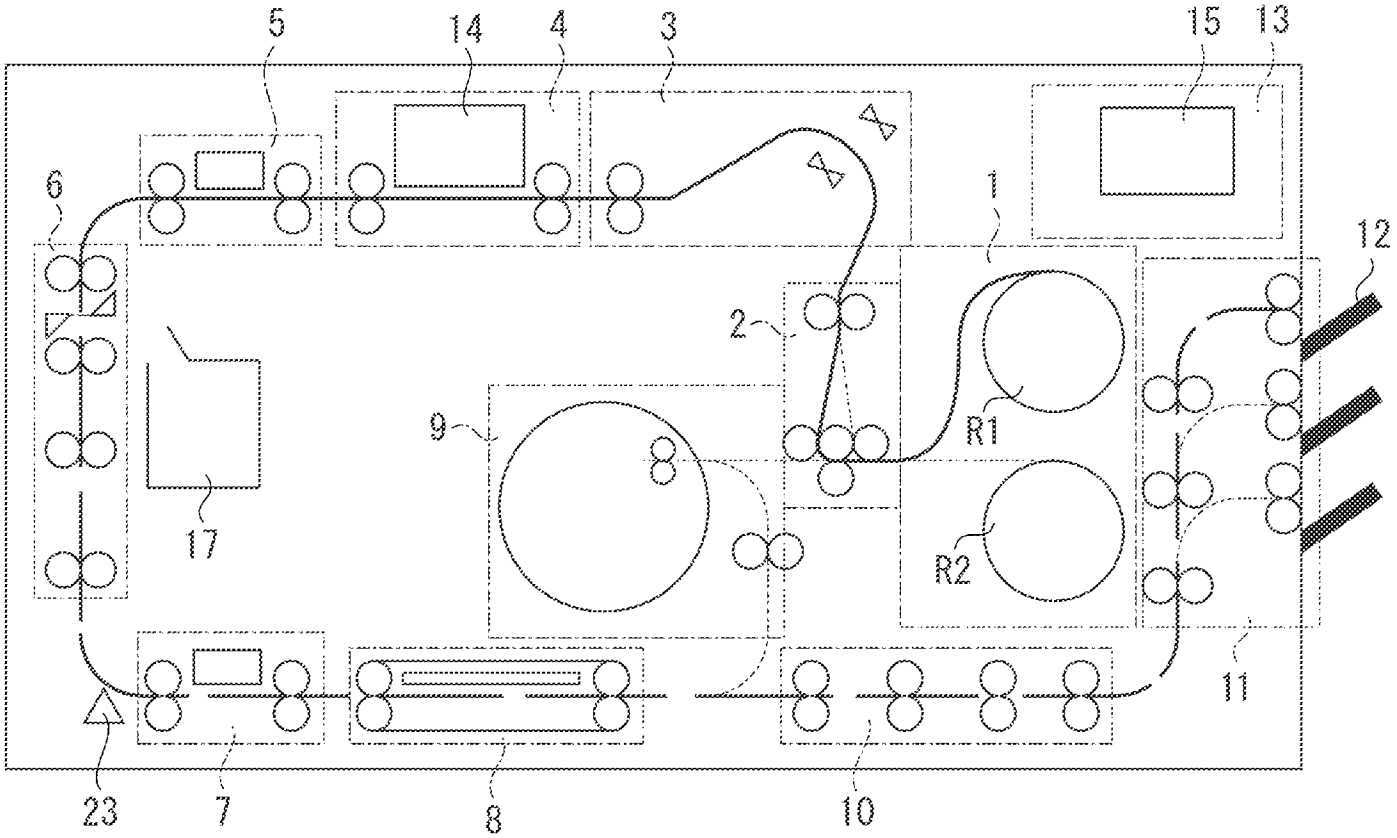
FIGS. 3A and 3B illustrate operation in a one-sided print mode and a two-sided print mode.

FIG. 3A illustrates the operation in the one-sided print mode. The sheet is supplied from the sheet supplying unit 1, and processed in the decurling unit 2 and the skew correction unit 3. On the front-side (first surface) of the processed sheet, printing is performed in the printing unit 4. Onto the long continuous sheet, an image (unit image) of a predetermined length in the conveyance direction is sequentially printed such that the images are formed side by side. The printed sheet passes through the inspection unit 5, and is cut off to each unit image in the cutter unit 6. On the back side of the cut sheets, as necessary, print information is recorded in the information recording unit 7. The cut sheets are conveyed to the drying unit 8 one by one, and dried. The sheets are further conveyed passing through the discharge and conveyance unit 10, and discharged and stacked onto the discharge unit 12 of the sorting unit 11. The sheet remaining at the side of the printing unit 4 when the last unit image is cut, is sent back to the sheet supplying unit 1, and wound by the roll R1 or R2. As will be described below, in the sending back operation, the decurl force in the decurling unit 2 is adjusted to be reduced, and the print heads 14 are retracted from the sheet.

As described above, in the one-sided printing, the sheet passes through the first path and the third path, and the sheet is processed, however, the sheet does not pass through the second path. In summary, in the one-sided print mode, under the control by the controllers in the control unit 13, the following sequence of (1) to (6) is executed:

(1) send a sheet from the sheet supplying unit 1 and supply the sheet to the printing unit 4;
(2) repeat printing of the unit image on the first surface of the supplied sheet by the printing unit 4;
(3) repeat cutting of the sheet for each unit image printed on the first surface by the cutter unit 6;
(4) pass the sheets cut for each unit image through the drying unit 8 one by one;
(5) discharge the sheets passed through the drying unit 8 one by one onto the discharge unit 12 via the third path;
(6) send back the sheet remaining at the side of the printing unit 4 when the last unit image is cut, to the sheet supplying unit 1.

<Two-sided Print Mode>

Figure 3B:
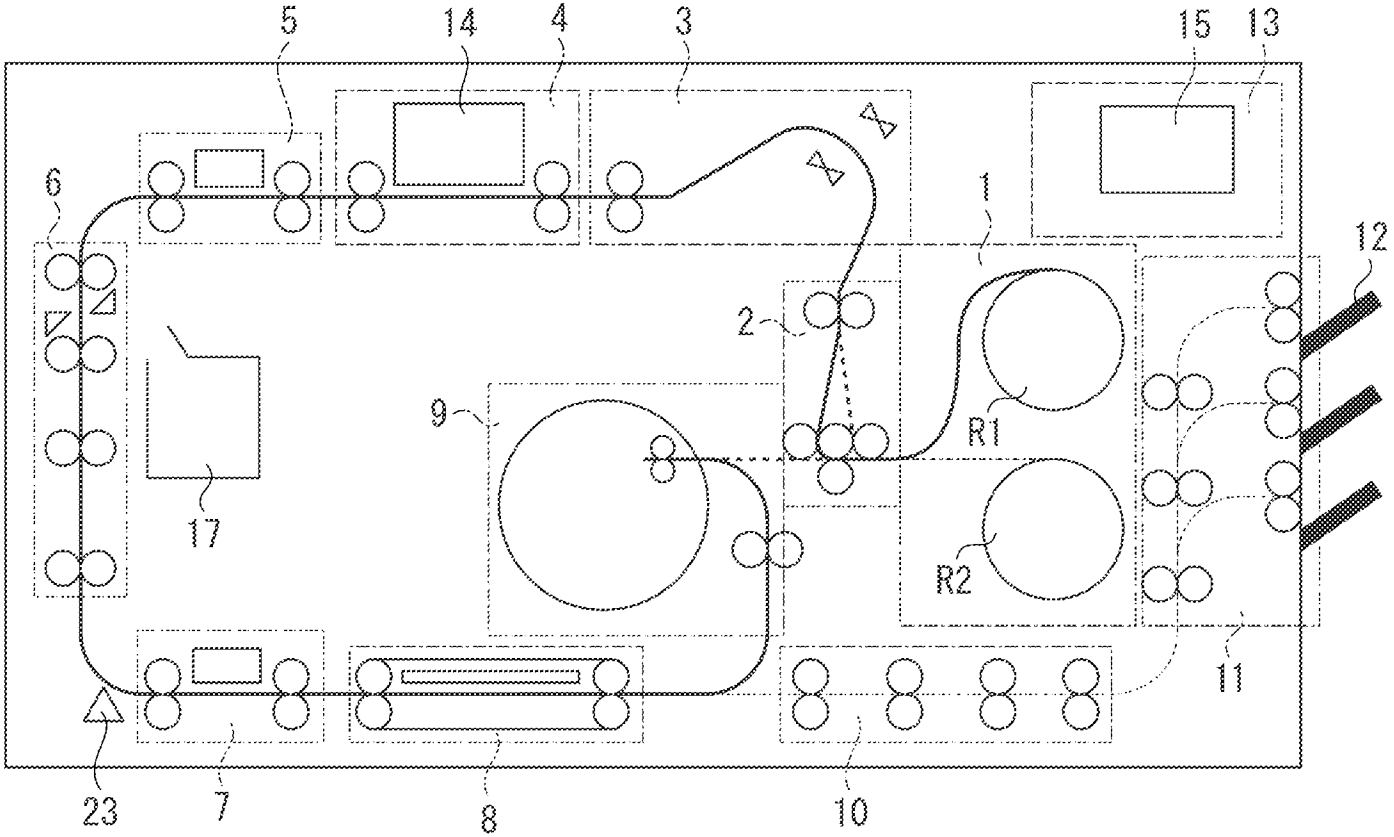

FIG. 3B illustrates the operation in the two-sided print mode. In the two-sided printing, after the print sequence of the front-side (the first surface), a print sequence of the back-side (the second surface) is performed. In the first sequence (the front-side printing), operation performed in each of the sheet supplying unit 1 to the inspection unit 5 is similar to that in the above-described one-sided printing. In the cutter unit 6, the cutting operation is not performed, and the sheet is conveyed to the drying unit 8 in continuous form. After the ink on the front-side is dried, the sheet is led to the path (the second path) of the side of the reversing unit 9 instead of the path (third path) on the side of the discharge and conveyance unit 10. In the second path, the sheet is wound around the rotary winding member in the reversing unit 9 that rotates in the forward direction (in the drawing, the counterclockwise direction). In the printing unit 4, when all of the predetermined printing on the front-side is completed, the trailing edge of the printed area on the continuous sheet is cut in the cutter unit 6. The continuous sheet on a downstream side (the printed side) in the conveyance direction passes through the drying unit 8 and all of the continuous sheet is wound by the reversing unit 9 up to the sheet trailing edge (the cut position) with reference to the cut position. Concurrently with the winding by the reversing unit 9, the continuous sheet remaining on a upstream side (the side of the printing unit 4) in the conveyance direction from the cut position is sent back to the sheet supplying unit 1, so that the sheet leading edge (the cut position) does not remain in the decurling unit 2. Further, the sheet is wound by the roll R1 or R2. The operation of sending back the sheet (feedback) prevents the sheet from hitting with the sheet to be supplied again in the following back-side print sequence. As will be described below, When the sheet is sent back, the decurl force in the decurling unit 2 is adjusted to be small, and the print heads 14 are retracted from the sheet.

After the above-described front-side print sequence, the processing is switched to the back-side print sequence. The rotary winding member in the reversing unit 9 rotates in the opposite direction (in the drawing, the clockwise direction) of the direction in the winding operation. The edge part (the trailing edge of the sheet in the winding operation becomes the leading edge in the sending out operation) of the wound sheet is sent to the decurling unit 2 along the path illustrated by the dashed line in the drawing. The decurling unit 2 corrects the curl given by the rotary winding member. More specifically, the decurling unit 2 is provided between the sheet supplying unit 1 and the printing unit 4 in the first path, and between the reversing unit 9 and the printing unit 4 in the second path. In the both paths, the decurling unit 2 operates as a common unit functioning as a decurling unit.

The inverted sheet is conveyed through the skew correction unit 3 to the printing unit 4. On the back-side of the sheet, printing is performed. The printed sheet passes through the inspection unit 5, and is cut off in the each predetermined unit length in the cutter unit 6. On the both sides of the cut sheet, printing is performed. Accordingly, the recording in the information recording unit 7 is not performed. The cut sheets are conveyed to the drying unit 8 one by one, passing through the discharge and conveyance unit 10, and sequentially discharged and stacked onto the discharge unit 12 of the sorting unit 11.

As described above, in the two-sided printing, the sheet is conveyed and processed sequentially passing through the first path, the second path, the first path, and the third path. In summary, in the two-sided print mode, under the control by the controllers in the control unit 13, the following sequence of (1) to (11) is executed:

(1) send a sheet from the sheet supplying unit 1 and supply the sheet to the printing unit 4;
(2) repeat printing of the unit image on the first surface of the supplied sheet by the printing unit 4;
(3) pass the sheet with the first surface printed, through the drying unit 8;
(4) lead the sheet that has passed through the drying unit 8 to the second path, and wind the sheet around the rotary winding member in the reversing unit 9;
(5) after the completion of the repeated printing onto the first surface, cut the sheet with the cutter unit 6 at a position behind the last printed unit image;
(6) wind the sheet around the rotary winding member such that the edge part of the cut sheet passes through the drying unit 8 and reaches the rotary winding member, and at the same time, send back the cut sheet remaining at the side of the printing unit 4 to the sheet supplying unit 1;
(7) after the completion of the winding operation, reversely rotate the rotary winding member and supply the sheet again from the second path to the printing unit 4;
(8) repeat printing of the unit image on the second surface of the sheet, which is supplied from the second path, by the printing unit 4;
(9) repeat cutting of the sheet for each unit image printed on the second surface by the cutter unit 6;
(10) pass the sheets cut for each unit image through the drying unit 8 one by one;
(11) discharge the sheet that has passed through the drying unit 8 one by one to the discharge unit 12 via the third path.

Figure 4:
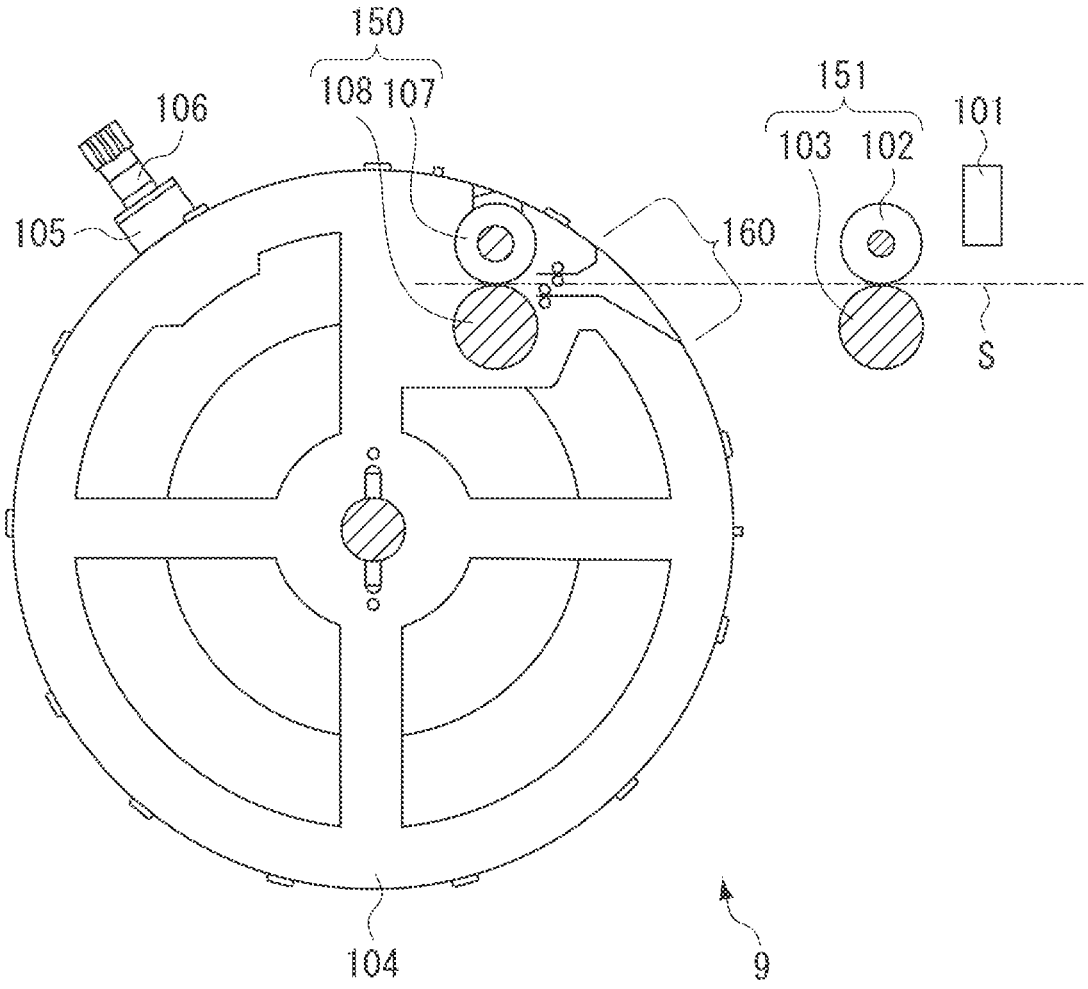
FIG. 4 is a cross-sectional view illustrating a structure around a rotary winding member.

The operation of the reversing unit 9 that is a feature of the above-described printing apparatus is further specifically described. FIG. 4 is a cross-sectional view illustrating a structure of the main units around the rotary winding member of the reversing unit 9. At least a part of the rotary winding member 104 has a hollow cylindrical shape (drum shape). The cylindrical surface serves as a sheet winding surface. A first roller pair 151 that includes a conveyance roller 102 and a pinch roller 103 introduces or discharges a sheet S to the rotary winding member 104. In front of the conveyance roller 102, an edge sensor 101 is provided. The edge sensor 101 detects the leading edge of the sheet to be introduced to the reversing unit 9.

In the vicinity of the cylindrical front-side (the inner side of the cylindrical face that serves as a sheet winding surface) of the rotary winding member 104, a supporting roller pair 150 that includes a supporting roller 108 and a pinch roller 107 is provided. The supporting roller pair 150 can nip the leading edge of the sheet and rotate. The pinch roller 107 is pushed against the supporting roller 108 with a predetermined force, and driven to be rotated. A sheet insertion part 160 is formed in a slit-like shape in a part of the winding surface of the rotary winding member 104. Into the sheet insertion portion 160, the leading edge of the introduced sheet S is inserted. The leading edge of the inserted sheet S is to be nipped and supported by the supporting roller pair 150. The rotation of the supporting roller pulls the inserted sheet into the inner space of the rotary winding member 104. In other words, the supporting roller pair 150 has a function as a clamper for holding the sheet and a function as a conveyance means for conveying the sheet.

Both of the supporting roller 108 and the pinch roller 107 of the supporting roller pair 150 can have driving force. The shape of the supporting roller 108 and the pinch roller 107 is not limited to the roller shape. One of the rollers or both of the rollers can be a rotator such as an endless belt rotator. Alternatively, one of the rollers can be a rotator having driving force, and the other roller can have a simple slide surface. The supporting roller pair 150 including the supporting roller 108 and the pinch roller 107 is only an example. As long as the function of nipping the leading edge of the sheet and rotating to convey the sheet is provided, anything can be employed. In the description, a generic term of "rotary supporting member" is used to refer to such various examples.

A flag 105 is a reference member for detecting the original position (initial position) of the rotation position of the rotary winding member 104. A rotation sensor 106 detects the rotation position of the rotary winding member 104. In FIG. 4, the rotary winding member 104 is positioned at the initial position, and the sheet insertion part 160 faces the introduction path of the sheet S.

A first drive mechanism for rotationally driving the rotary winding member 104 is provided on one side surface of the rotary winding member 104. A second drive mechanism for rotationally driving at least one roller (the supporting roller 108) of the supporting roller pair 150 is provided on the other side surface of the rotary winding member 104.

Figure 5A:
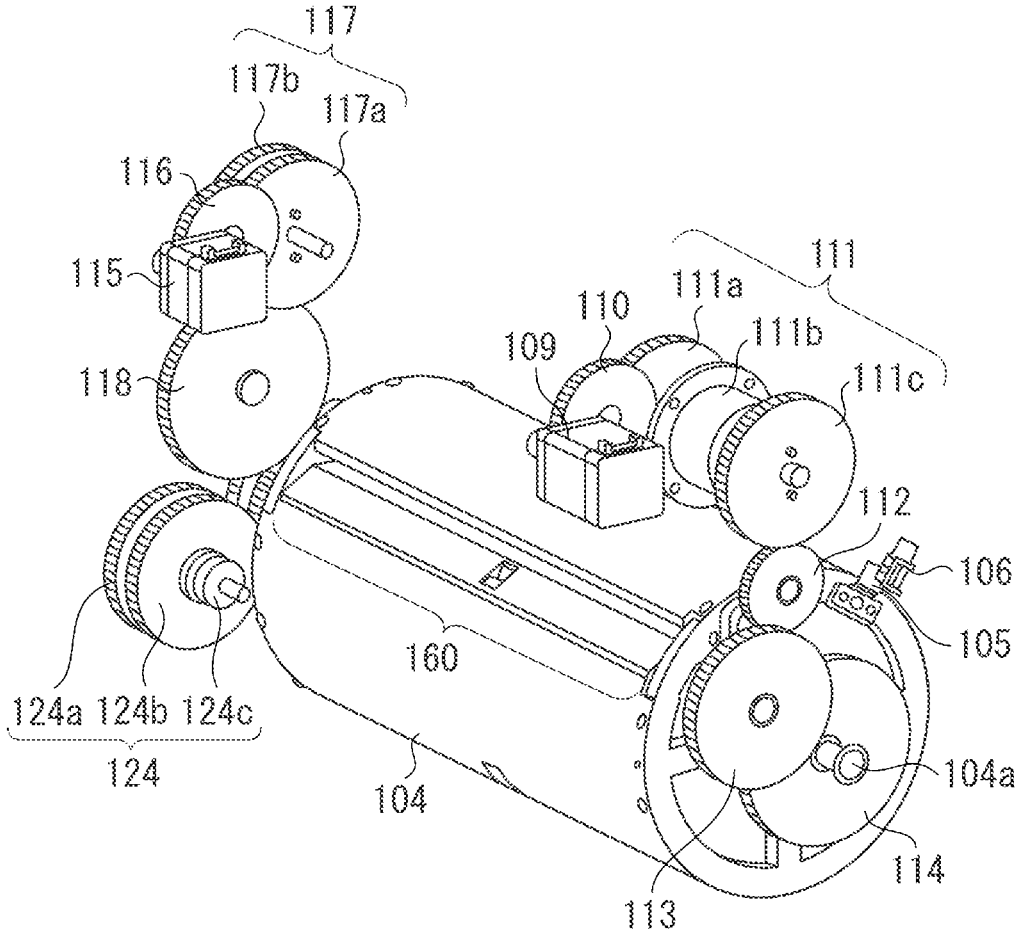
FIGS. 5A and 5B are perspective views illustrating a structure of a drive mechanism of the rotary winding member.
Figure 5B:
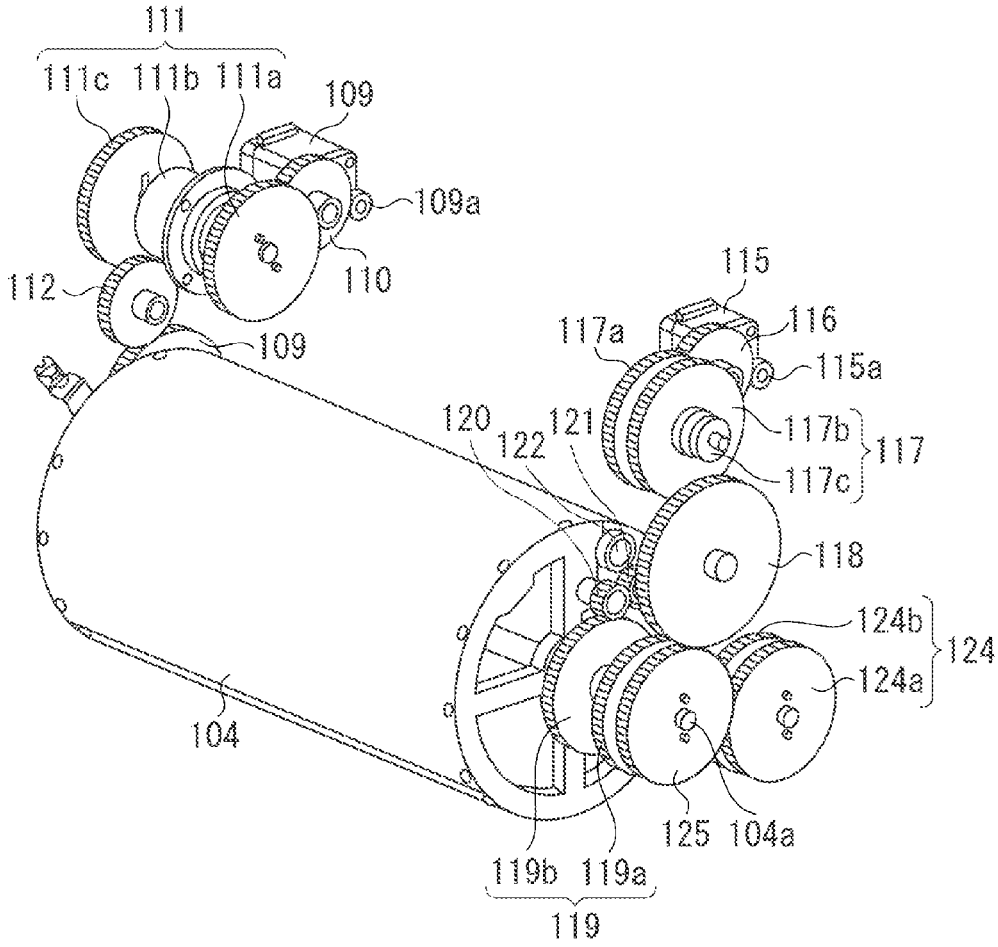

FIGS. 5A and 5B are perspective views illustrating a structure of the drive mechanism of the rotary winding member 104. In FIG. 5A, the first drive mechanism is provided at the right side surface of the rotary winding member 104 in the drawing. The second drive mechanism is provided at the left side surface of the rotary winding member 104 in the drawing. FIG. 5B is a view from the opposite side of the FIG. 5A. The second drive mechanism is provided at the right side surface of the rotary winding member 104 in the drawing. The first drive mechanism is provided at the left side surface of the rotary winding member 104 in the drawing.

Figure 6A:
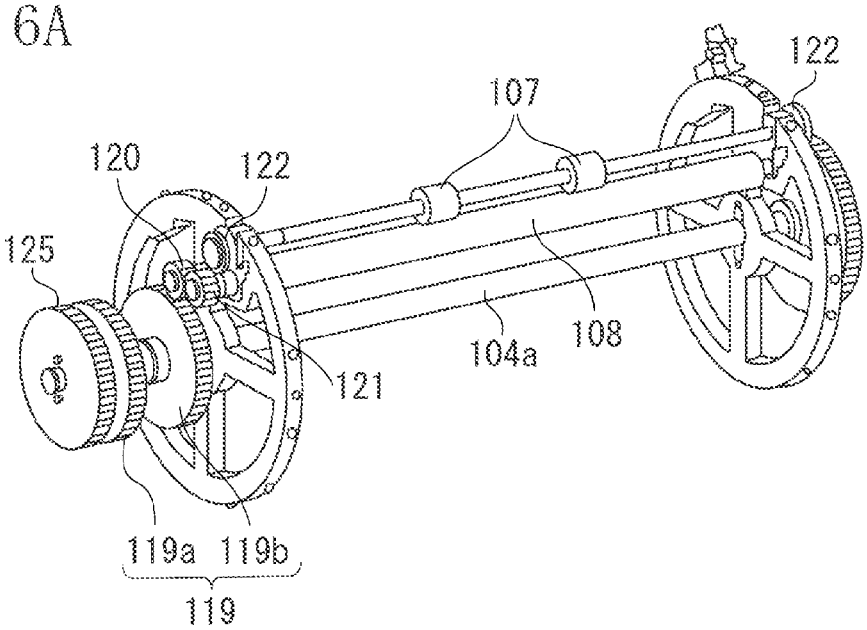
FIGS. 6A and 6B illustrate a configuration of a second gear mechanism.
Figure 6B:
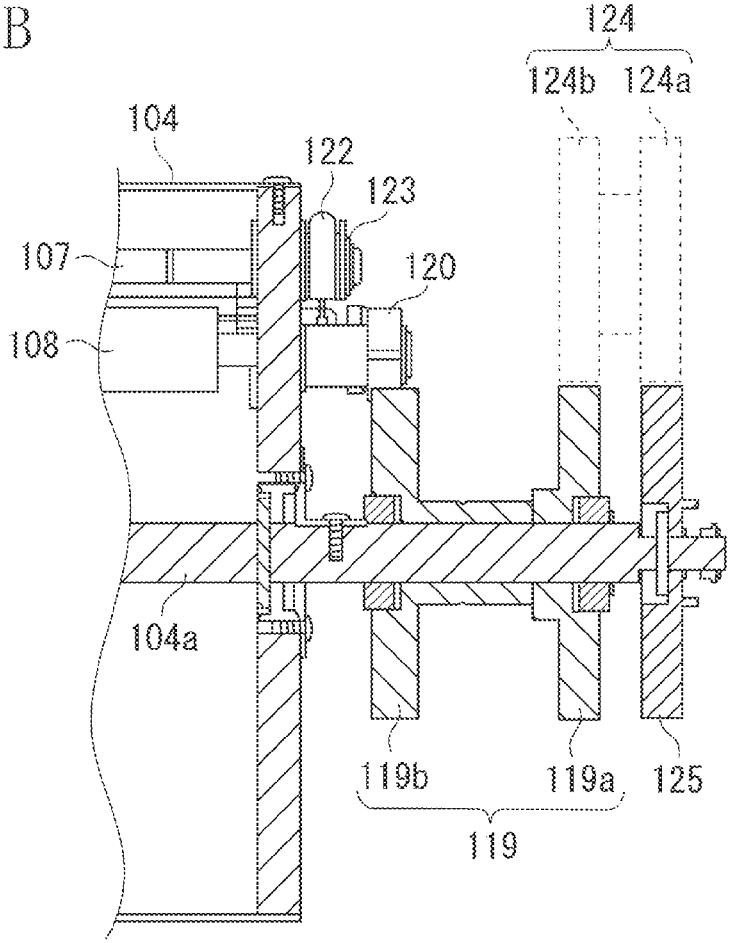
Figure 7:
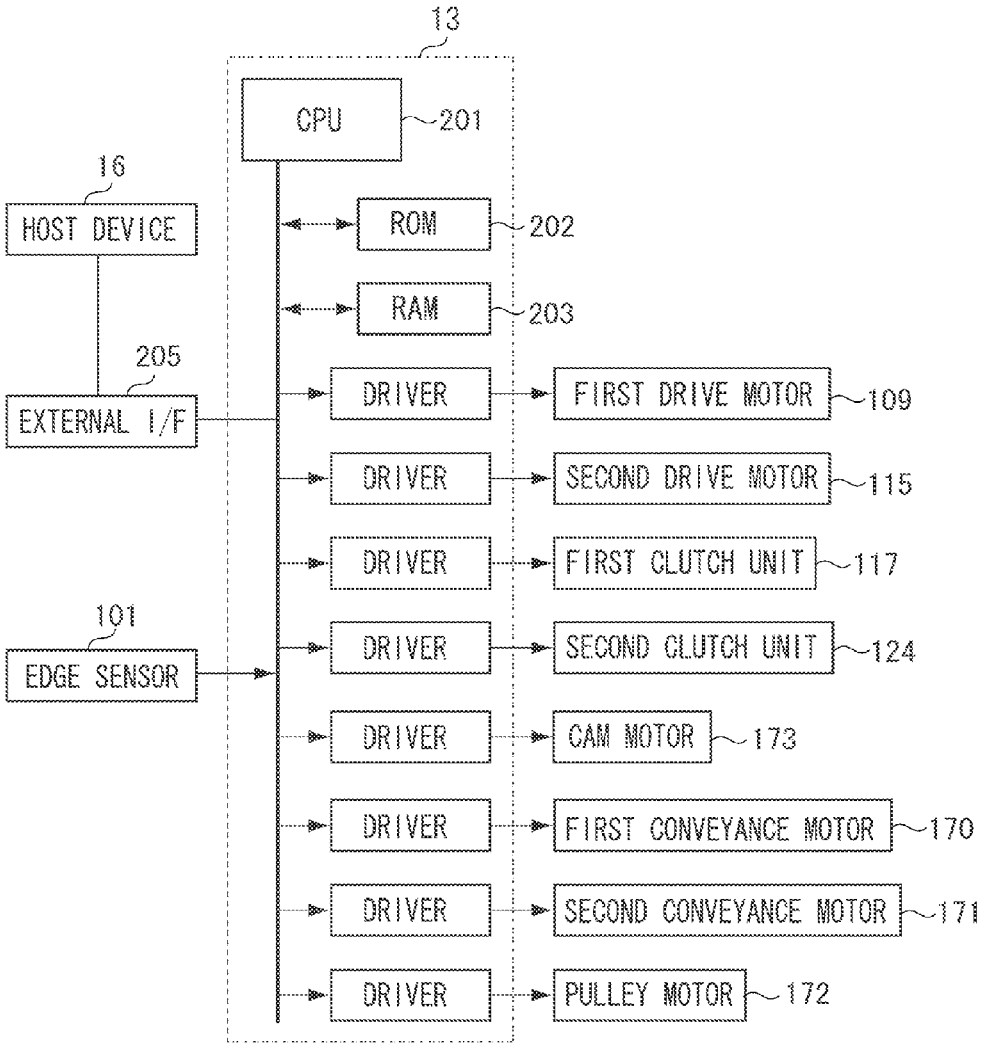
FIG. 7 is a block diagram illustrating a configuration relating to control of a reversing unit.

FIGS. 6A and 6B illustrate a structure of a main part of a second gear mechanism. FIG. 6A is a perspective view illustrating a hollow internal structure of the rotary winding member 104 from which the winding surface is removed. FIG. 6B is a cross-sectional view illustrating gear engagement. FIG. 7 is a block diagram illustrating a configuration relating to control of the reversing unit. FIG. 7 illustrates detailed elements included in the individual unit control unit other than the CPU, the ROM, the RAM, and the like illustrated in FIG. 2.

Now, the first drive mechanism is described. The first drive mechanism includes a first drive motor 109 and a first gear train. The first gear train transmits rotation of the first drive motor 109 to the rotary shaft of the rotary winding member 104. The first gear train includes a motor gear 109*a*, a gear 110, a clutch unit 111, a gear 112, a gear 113, and a drum gear 114. The clutch unit 111 includes an input gear 111*a*, an output gear 111*c*, and a clutch unit 111*b*. The clutch unit 111 can manage the transmission of the drive and tension in winding the sheet. The clutch unit 111 does not transmit 100% of the input torque, but, in order to output the torque of a constant value, the clutch unit 111 transmits the driving force with the output gear 111*c* slipping, to the input gear 111*a*.

The rotation of the first drive motor 109 is reduced by the first gear train at a predetermined gear ratio, and transmitted to the drum gear 114. The drum gear 114 is fixed to a rotary shaft 104*a*, that is the center of the rotation of the rotary winding member 104. The drum gear 114 integrally rotates with the rotary winding member 104.

In the sheet winding operation, the rotation speed (the peripheral speed of the outer periphery of the wound sheet) of the rotary winding member 104 is controlled such that the rotation speed is faster than the conveyance speed of the sheet S that is introduced onto the rotary winding member 104 by the first conveyance roller pair 151. The speed difference is absorbed when the output gear 111*c* slips on the input gear 111*a* of the clutch unit 111. Consequently, the rotation speed of the rotary winding member 104 becomes similar to that of the first conveyance roller pair 151. In other words, the sheet conveyance speed in the sheet winding is determined mainly by the first conveyance roller pair 151. The slip produces a brake force to the rotary winding member 104 from the first conveyance roller pair 151 through the sheet, and as a result, a predetermined tension is applied to the sheet. The rotary winding member 104 rotates while being pulled by the predetermined force from the sheet, and winds the sheet.

Next, the second drive mechanism is described. The second drive mechanism includes a second drive motor 115 and a second gear train. The second gear train transmits rotation of the second drive motor 115 to the rotary shaft of the supporting roller 108. The second gear train includes a motor gear 115*a*, a first clutch unit 117, a gear 118, a transmission gear 119, a gear 120, and a roller gear 121. The first clutch unit 117 includes an input gear 117*a*, an output gear 117*b*, and a clutch unit 117*c*. The first clutch unit 117 can switch transmission and disconnection of torque.

The rotation of the second drive motor 115 is reduced by the second gear train at a predetermined gear ratio, and transmitted to the roller gear 121. The roller gear 121 is fixed to the rotary shaft that is the center of the rotation of the supporting roller 108. The roller gear 121 integrally rotates with the supporting roller 108. The transmission gear 119 includes an input gear 119*a* and an output gear 119*b*, which are integrated. Both of the input gear 119*a* and the output gear 119*b* have the same center of the rotation as the rotary shaft 104*a* of the rotary winding member 104, and can freely rotate around the rotary shaft 104*a*.

At an end part of the rotary shaft 104*a*, a lock gear 125 is fixed. Between the lock gear 125 and the transmission gear 119, a second clutch unit 124 that can switch driving force between transmission and disconnection is connected. The second clutch unit 124 includes an input gear 124*a* and an output gear 124*b*. The input gear 124*a* engages with the lock gear 125. The output gear 124*b* engages with the input gear 119*a*. In other words, the input gear 119*a* engages with two gears (the gear 118 and the output gear 124*b*).

The both end parts of the rotary shaft of the pinch roller 107 are rotatably supported by pinch roller bearings 123. The pinch roller bearing 123 is pressed downward by a pinch roller spring 122. By the pressure, the pinch roller 107 is pressed against the supporting roller 108.

In the above-described structure, when the supporting roller 108 is rotated by the second drive motor 115, the first clutch unit 117 is connected, and the second clutch unit 124 is disconnected. In this state, if the second drive motor 115 is driven, the rotation of the second drive motor 115 is transmitted to the roller gear 121 through the gear 120 to rotate the supporting roller 108. In the exemplary embodiment, the second drive motor 115 drives the supporting roller 108 that is one of the supporting roller pair 150. However, the pinch roller 107 can be driven. Alternatively, both of the supporting roller 108 and the pinch roller 107 can be driven.

When the sheet S is to be wound around the rotary winding member 104, the supporting roller 108 is set in a state where the supporting roller 108 does not rotate (the supporting roller 108 is locked to the rotary winding member 104) while the leading edge of the sheet S is being nipped by the supporting roller pair 150. In this case, the first clutch unit 117 is disconnected to cut off the torque from the second motor, and the second clutch unit 124 is connected. As a consequence, the transmission gear 119 rotates together with the lock gear 125 at the same speed, more specifically, the transmission gear 119 does not relatively rotate around the rotary shaft 104*a* (it can be considered that the transmission gear 119 is substantially integrated with the lock gear 125). As a result, the gear 120 and the supporting roller 108 do not relatively rotate around the rotary winding member 104. In such a state, if the first drive motor 109 is driven, the rotation of the first drive motor 109 is transmitted to the drum gear 114 and the rotary winding member 104 rotates. Consequently, the sheet S can be wound. In this operation, the supporting roller 108 rests without rotation.

Figure 8:
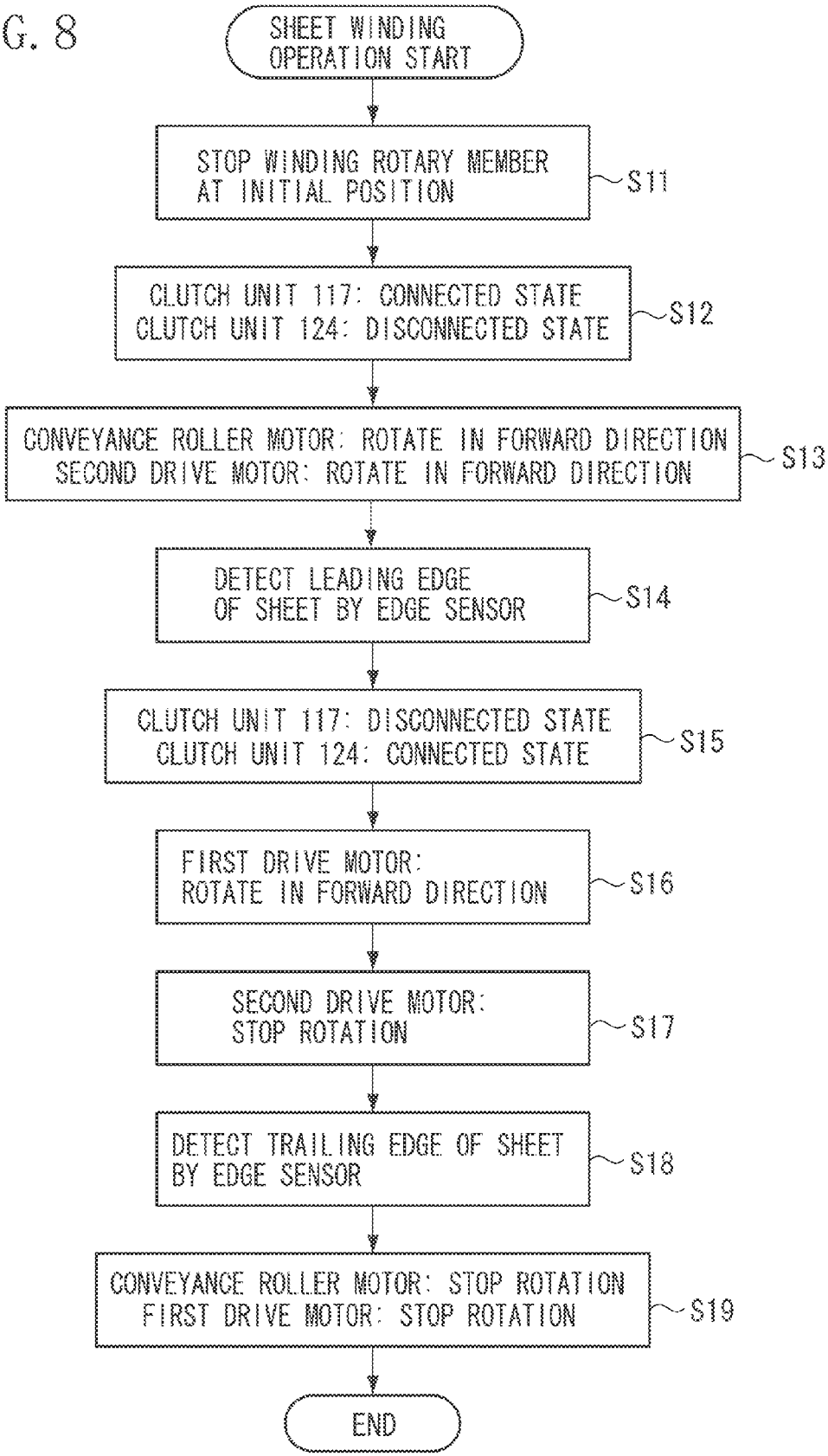
FIG. 8 is a flowchart illustrating an operational sequence in winding a sheet around the rotary winding member.
Figure 9A:
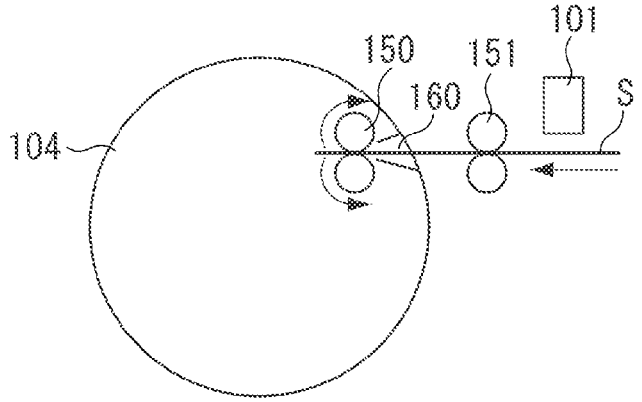
FIGS. 9A, 9B, and 9C illustrate operation in the sequence illustrated in FIG. 8.
Figure 9B:
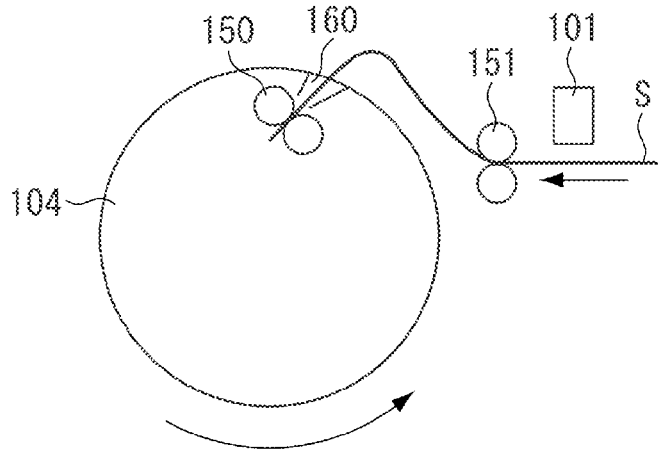
Figure 9C:
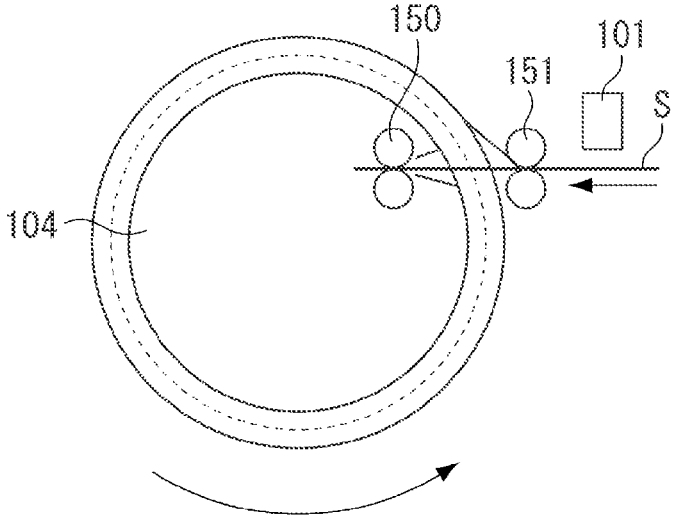

Next, specific operation of the reversing unit 9 in the two-sided printing is described. FIG. 8 is a flowchart illustrating an operation sequence performed when the sheet is wound around the rotary winding member of the reversing unit 9. FIGS. 9A to 9C illustrate the operation in the sequence.

In step S11, the rotary winding member 104 is rotated such that the rotary winding member 104 rests at the initial position illustrated in FIG. 4 at the time of the start of front-side printing in the two-sided print mode. At the initial position, the sheet insertion part 160 faces toward the introduction path of the sheet S. The sheet S to be introduced onto the rotary winding member 104 is smoothly inserted into the sheet insertion part 160.

In step S12, the first clutch unit 117 is connected and the second clutch unit 124 is disconnected. In this state, the supporting roller 108 can rotate against the rotary winding member 104.

In step S13, a first conveyance motor 170, which drives the conveyance roller 102, is driven such that the conveyance roller 102 rotates in the forward direction (the sheet winding direction). Simultaneously, the second drive motor 115 is driven such that the supporting roller 108 rotates in the forward direction (the direction the sheet is pulled into the inside of the rotary winding member). At this time, the feeding speed of the conveyance roller 102 and the feeding speed of the supporting roller 108 is controlled to be the same speed.

In step S14, the edge sensor 101 detects the leading edge of the sheet S passing through the edge sensor 101. When the leading edge is detected, the sheet S is conveyed to a position the leading edge of the sheet S passes through the nip portion of the supporting roller pair 150 (see the state illustrated in FIG. 9A).

In step S15, the first clutch unit 117 is disconnected such that the drive of the second drive motor 115 is not transmitted to the supporting roller 108. The second clutch unit 124 is connected such that the supporting roller 108 stops against the rotary winding member 104.

In step S16, the first drive motor 109 is driven such that the rotary winding member 104 rotates in the forward direction (the sheet winding direction) to start the winding of the sheet S around the rotary winding member 104 (see the state illustrated in FIG. 9B).

In step S17, after a predetermined time period has passed from the start of the rotation of the first drive motor 109, the rotation of the second drive motor 115 is stopped. The first drive motor 109 continues the rotation to carry on the sheet winding operation. As the length of the wound sheet increases, the thickness of the sheet wound around the rotary winding member 104 increases (see the state illustrated in FIG. 9C).

Since the speed of the introduction of the sheet is constant, the sheet winding speed is to be kept constant in conjunction with the introduction speed. For that purpose, when the sheet is wound, the rotation speed of the first drive motor is set such that the rotation speed of the first drive motor is faster than the conveyance speed of the sheet S to be introduced onto the rotary winding member 104 by the first conveyance roller pair 151. In the clutch unit 111, since the output gear 111*c* slips on the input gear 111*a*, even if the thickness of the wound sheet increases, the rotation speed of the rotary winding member 104 keeps constant in conjunction with the first conveyance roller pair 151.

The first conveyance roller pair 151 is a part of the conveyance mechanism for introducing the sheet to the rotary winding member. The first conveyance roller pair 151 and the first drive mechanism are related with each other such that when the sheet introduced by the first conveyance roller pair 151 is wound by the rotary winding member 104, the speed (peripheral speed) of winding the sheet by the rotary winding member 104 is faster than the sheet conveyance speed by the first conveyance roller pair 151, and the overall sheet conveyance speed is led by the first conveyance roller pair 151. The leading by the first conveyance roller pair 151 means that the overall sheet conveyance speed is determined mainly by the speed of the first conveyance roller pair 151. The sheet winding speed by the rotary winding member 104 is set to be faster than the sheet conveyance speed by the first conveyance roller pair 151 irrespective of the thickness of the sheet wound around the rotary winding member 104.

In another method, in order to prevent change of the rotating peripheral speed (sheet winding speed) of the outer periphery of the sheet even if the thickness of the wound sheet increases, the rotating angular speed of the first drive motor can be controlled such that the rotating angular speed slightly decreases bit by bit with the increase in the thickness of the wound sheet. The information about the thickness of the wounded sheet can be acquired from the length of the wound sheet.

When all printing operation onto the front-side of the sheet is completed, the trailing edge of the sheet is cut by the cutter. The winding operation in the reversing unit 9 is continued.

In step S18, the edge sensor 101 detects the trailing edge (the outermost edge of the sheet, on the front-side of the sheet which is printed and cut) of the sheet S to be introduced. When the trailing edge of the sheet S passes through the sensor detection position, the signal output of the edge sensor 101 changes from "ON: sheet exists" to "OFF: no sheet". By checking the change of the signal output, the edge of the sheet is detected. When the edge of the sheet is detected, the processing proceeds to step S19.

In step S19, the first drive motor 109 stops rotation to stop the rotation of the rotary winding member 104, and further, the first conveyance motor 170 stops rotation to stop the rotation of the conveyance roller 102. The rotation of the rotary winding member 104 is stopped first and after a predetermined time period has passed, the conveyance roller 102 is stopped. Thus, a slack is formed in the outermost periphery of the rotary winding member 104. The slack is formed to facilitate elimination of a skew when the following sheet is sent out from the rotary winding member 104.

In another method, the rotation of the first conveyance motor 170 in the conveyance roller 102 is stopped simultaneously with the stop of the rotation of the first drive motor 109, and the sheet is sent out from the rotary winding member 104, so that a slack can be formed in the outer periphery of the rotary winding member 104 by starting the rotation of the first drive motor 109 first.

The position the sheet S is to be introduced is a position the trailing edge of the sheet S detected by the edge sensor 101 does not pass through the nipping position and the nipping state is kept by the first conveyance roller pair 151. In the above position, the following sending operation of the sheet is facilitated. Thus, the sheet winding operation in the front-side printing ends.

Figure 10A:
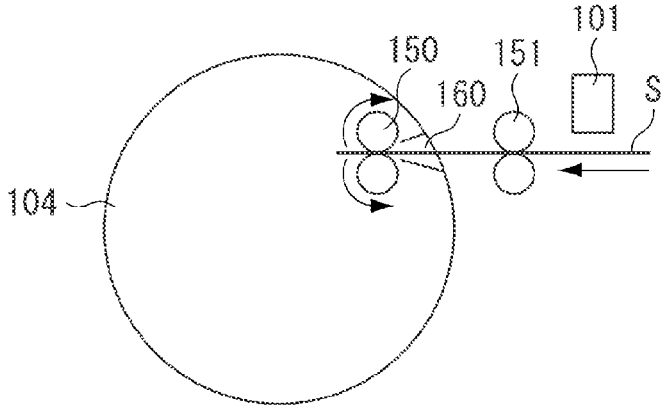
FIGS. 10A, 10B, and 10C illustrate behavior in sheet introduction in another case.
Figure 10B:
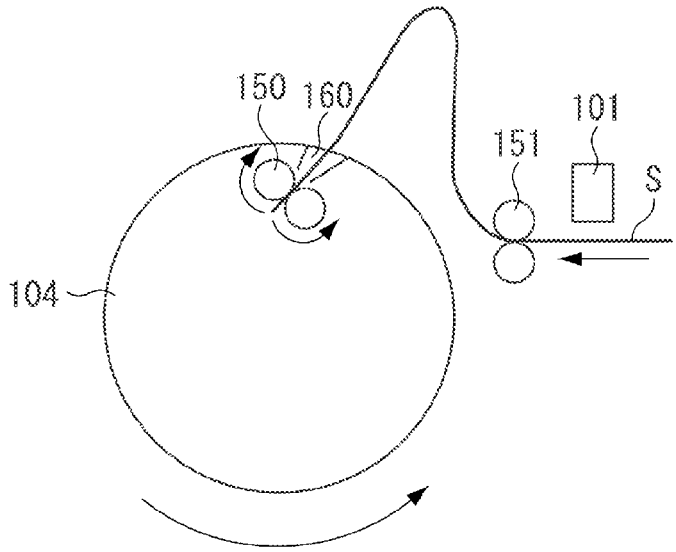
Figure 10C:
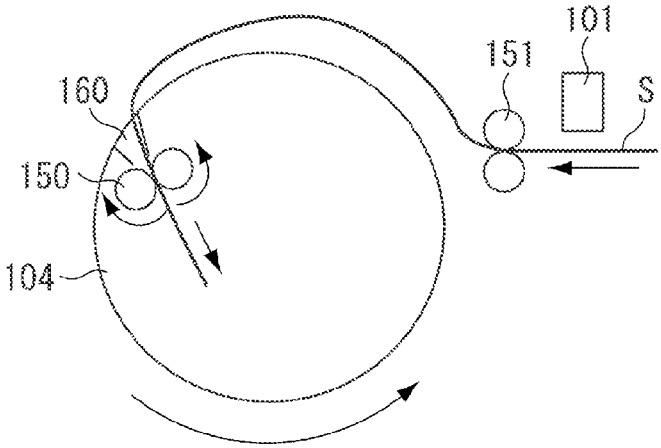

FIGS. 10A, 10B, and 10C illustrate behavior in another case at the time of introducing the sheet. As the introduction speed of the sheet S by the first conveyance roller pair 151 increases, the amount of the sheet S being sent in increases while the leading edge of the sheet S is inserted into the sheet insertion part 160 and clamped by the supporting roller pair 150 (see the state illustrated in FIG. 10A). This can generate a loop (slack) between the first conveyance roller pair 151 and the supporting roller pair 150 (see the state illustrated in FIG. 10B). If the loop is too large, it may cause failure of the winding. To solve the problem, the time the supporting roller 108 rotates when the sheet winding is started is increased to eliminate the generated loop (see the state illustrated in FIG. 10C). The time of the rotation of the supporting roller 108 is determined from the time necessary for clamping the leading edge of the sheet S, the conveyance speed of the sheet by the first conveyance roller pair 151, and the rotation speed of the supporting roller 108.

Figure 11:
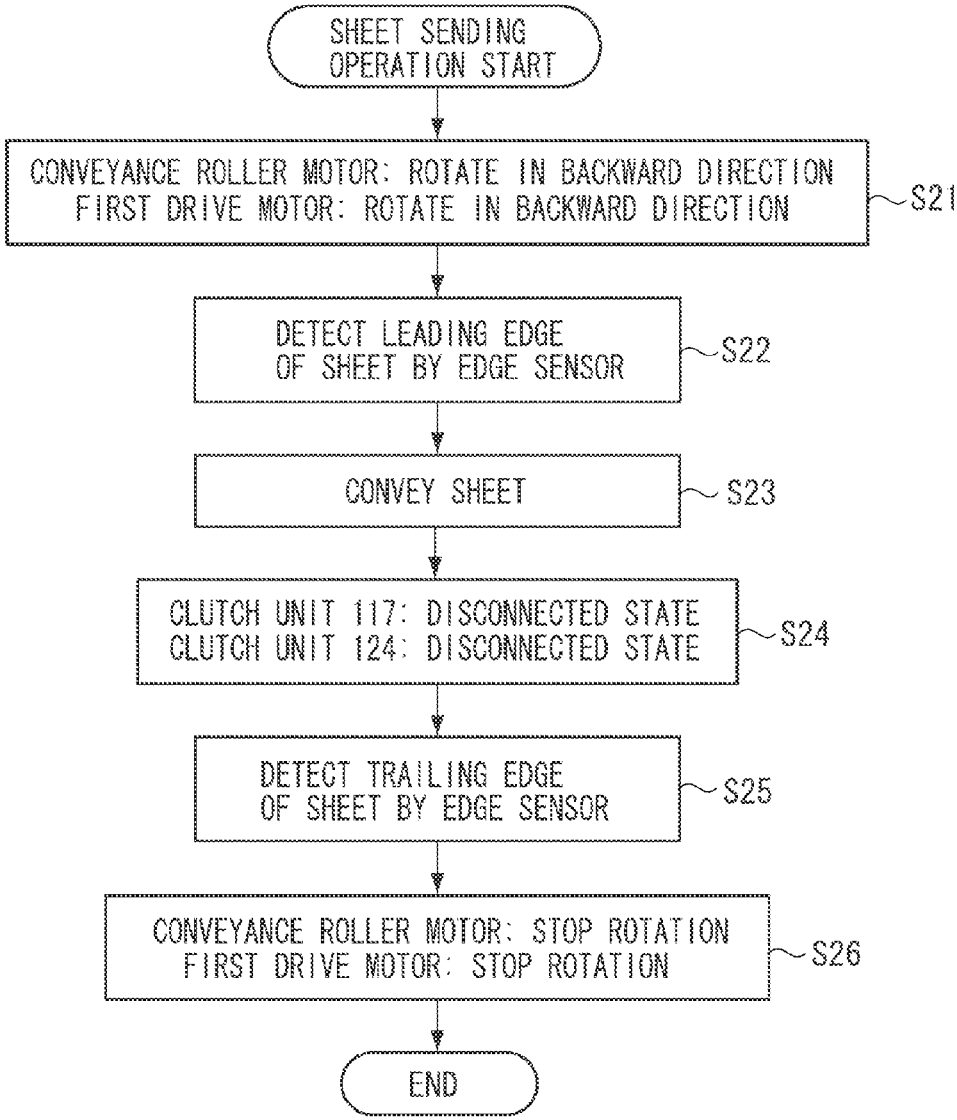
FIG. 11 is a flowchart illustrating an operational sequence in sending the sheet from the rotary winding member.

Following the above-described winding operation, the back-side printing is performed. FIG. 11 is a flowchart illustrating an operational sequence in sending out the sheet from the rotary winding member.

In step S21, the first conveyance motor 170 is driven such that the conveyance roller 102 rotates in the backward direction (the sheet sending direction). The first drive motor 109 is driven such that the rotary winding member 104 rotates in the backward direction (the sheet rewinding direction).

In step S22, when the operation of sending out the sheet from the rotary winding member starts, the edge sensor 101 detects the leading edge (the outermost edge of the sheet, on the front-side of which the printing is performed and cut) of the sheet S that is sent out. When the leading edge of the sheet S passes through the sensor detection position, the signal output of the edge sensor 101 changes from "OFF: no sheet" to "ON: sheet exists". By checking the change of the signal output, the edge of the sheet is detected. When the edge of the sheet is detected, the processing proceeds to step S23.

In step S23, the detection in step S22 is set as the base point to count the conveyance amount (the length of the sent sheet) of the sheet. The conveying operation of the sheet is continued until the count reaches a predetermined value. The predetermined value is the length of the sheet being wound around the rotary winding member 104.

Since the speed the sheet is sent to the printing unit 4 is constant, in order to prevent the rotating peripheral speed (sheet winding speed) of the outer periphery of the sheet from changing even if the thickness of the wound sheet decreases, the rotating angular speed of the first drive motor is controlled such that the rotating angular speed slightly increases bit by bit along with the decrease in the thickness of the wound sheet. The information about the thickness of the wound sheet can be acquired from the length of the sent sheet. Consequently, without having a means for measuring the number of rotations of the rotary winding member 104 such as a rotary encoder, the sheet can be sent at a constant speed.

In step S24, immediately before the trailing edge of the sheet S passes through the nip of the supporting roller pair 150, the first clutch unit 117 and the second clutch unit 124 are disconnected. As a result, the both clutches are in a disconnected state, and the supporting roller 108 is rotatable free from an influence of the second drive motor 115 and the rotary winding member 104. Consequently, both of the supporting roller 108 and the pinch roller 107 rotate in a driven state relative to the pulled sheet S, and the trailing edge of the sheet S can be pulled from the nip of the supporting roller pair 150 with a small resistance.

In step S25, the edge sensor 101 detects the trailing edge of the sheet S being sent out. When the trailing edge of the sheet S passes through the sensor detection position, the signal output of the edge sensor 101 changes from "ON: sheet exists" to "OFF: no sheet". By checking the change of the signal output, the edge of the sheet is detected. When the change of the signal output is detected, the processing proceeds to step S26.

In step S26, the rotation of the first conveyance motor 170 in the conveyance roller 102 is stopped, and further, the rotation of the first drive motor 109 is stopped. By the operation, the sheet sending operation in the back-side printing ends. By the operation describe above, the printing is performed on the back-side of the sent sheet, and the printing on the both sides of the sheet is completed.

As described above, when the introduced sheet S is inserted into the nip of the supporting roller pair 150, the supporting roller 108 rotates in the direction the leading edge of the sheet is pulled in. This ensures the clamp of the sheet S on the rotary winding member 104. In the following sheet winding operation, the supporting roller 108 relatively rests on the rotary winding member 104. Consequently, the sheet S is surely clamped and stably wound. When the sheet is sent out from the rotary winding member 104, the supporting roller 108 is freely rotated in a driven state relative to the sheet. Consequently, the trailing edge of the sheet S can be smoothly pulled from the nip of the supporting roller pair 150.

When the trailing edge of the sheet S is pulled from the supporting roller pair 150, the supporting roller pair 150 is passively rotated, however, the supporting roller pair 150 may actively rotate. To implement this, before the trailing edge of the sheet S is pulled from the nip of the supporting roller pair 150, the first clutch unit 117 is connected and the second clutch unit 124 is disconnected. Further, the second drive motor 115 is rotated in the direction opposite to the direction at the time of introduction in order to actively discharge the sheet S that is being nipped by the supporting roller pair 150. The discharge speed in this operation is set to the same speed as the sheet conveyance speed by the first conveyance roller pair 151. When the edge sensor 101 detects the passage of the sheet edge part, the rotation of the second drive motor 115 and the first conveyance motor 170 of the conveyance roller 102 is stopped. By actively rotating the supporting roller 108, the trailing edge of the sheet S can be smoothly pulled from the nip of the supporting roller pair 150.

Figure 12:
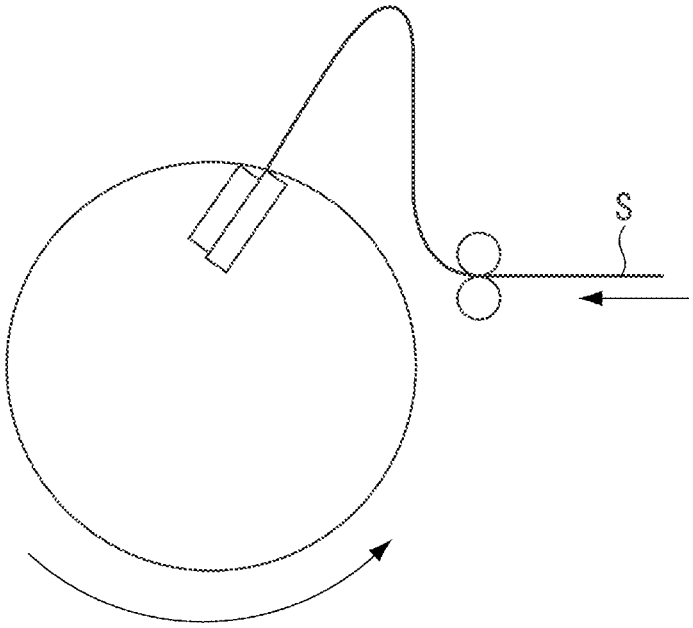
FIG. 12 illustrates generation of a loop of the sheet in winding the sheet.

As described above, by the use of the supporting roller pair 150 that serves as the rotary supporting member that can nip the leading edge of the sheet and rotate, the introduction and discharge of the sheet can be smoothly performed and damage to the leading edge of the sheet can be avoided. In addition, generation of a loop (slack) in the sheet at the initial stage of the winding, for example, the loop illustrated in FIG. 12 can be prevented. Consequently, the sheet can be surely wound.

Meanwhile, when the sheet is wound around the rotary winding member 104, if the sheet is introduced in a slanting direction (a skew occurs), the sheet may be wound around the rotary winding member 104 in a slanting state. In order to prevent this, in the reversing unit 9, a skew correction unit for correcting the skew of the sheet relative to the rotary winding member 104 is provided.

Figure 13A:
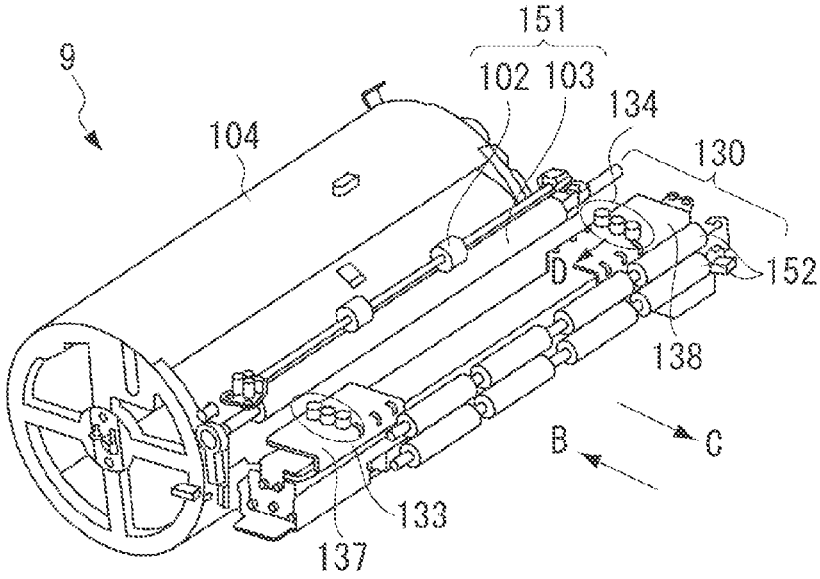
FIGS. 13A and 13B are perspective views illustrating a skew correction unit.
Figure 13B:
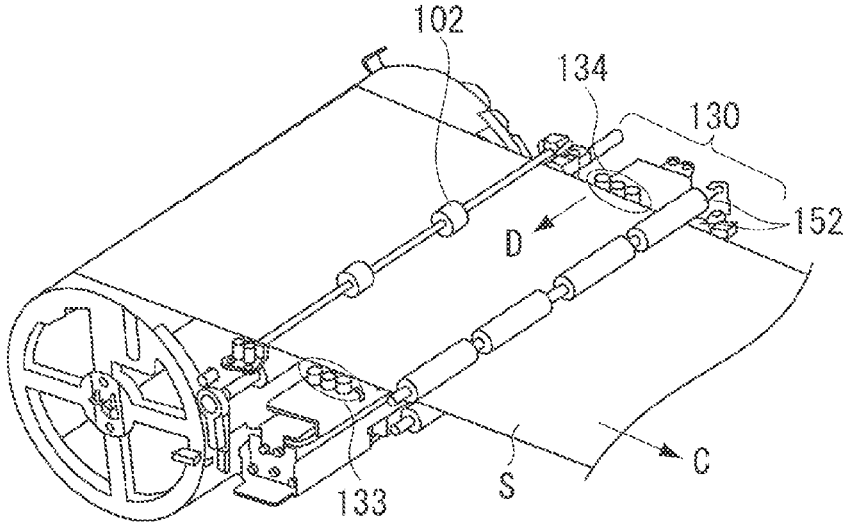

FIGS. 13A and 13B are perspective views illustrating a structure of the skew correction unit provided in front of the rotary winding member 104. In FIG. 13A, in front of the rotary winding member 104 and further in front of the first conveyance roller pair 151, a skew correction unit 130 is provided. The skew correction unit 130 includes a first correction roller 133, a second correction roller 134, a second conveyance roller pair 152, and upper and lower guiding plates (not illustrated). The rotation of the first conveyance roller pair 151 and the rotation of the second conveyance roller pair 152 are individually controlled. The second conveyance roller pair 152 is driven by a second conveyance motor 171. Alternatively, the first conveyance roller pair 151 and the second conveyance roller pair 152 can be respectively driven through a clutch by the first conveyance motor 170 and the drive and stop operation of the roller pairs 151 and 152 can be switched by the clutch.

At least one of the first conveyance roller pair 151 is separated from the other roller by a cam mechanism. The cam mechanism is driven by a cam motor 173.

In the first correction roller 133, a plurality of small rollers (in the exemplary embodiment, three driven rollers) whose rotary shafts are vertical to the surface of the sheet are arranged along the sheet conveyance direction. The individual small rollers can come in contact with one sheet side of the conveyed sheet S. The second correction roller 134 has a structure similar to the first correction roller 133. The second correction roller 134 can come in contact with the other sheet side part of the conveyed sheet S. Further, although not illustrated in FIG. 13, in the sheet conveyance direction, guiding plates are provided between the first correction roller 133 (the second correction roller 134) and the first conveyance roller pair 151. The guiding plates guide the surface of the passing sheet S in an upper part and a lower part.

Figure 14:
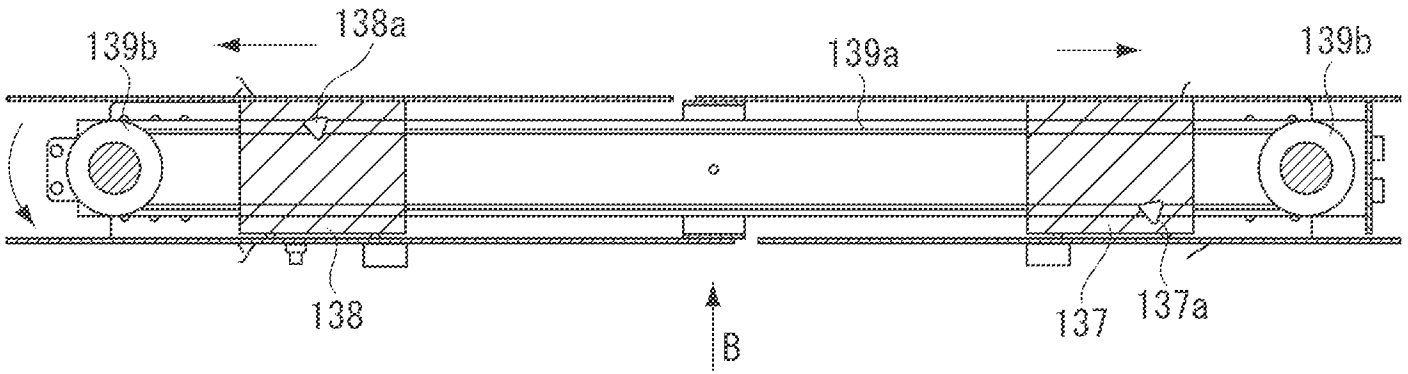
FIG. 14 illustrates a structure of an adjustment mechanism for adjusting the space between correction rollers.

FIG. 14 illustrates an adjustment mechanism for changing the space between the first correction roller 133 and the second correction roller 134 by moving the first correction roller 133 and the second correction roller 134 in the sheet width direction. The first correction roller 133 is mounted on a base 137. The second correction roller 134 is mounted on a base 138. The base 137 and the base 138 can be moved in the directions illustrated in the drawing respectively by a drive mechanism having a driving belt 139*a* and two pulleys 139*b*. One of or both of the two pulleys 139*b* are connected to a pulley motor 172, and rotate. The base 137 is clamped to a drive belt 139*a* at a position 137*a*. The base 138 is clamped to the drive belt 139*a* at a position 138*a*. The position 137*a* and the position 138*a* are on the opposite sides on the belt.

In such a structure, if the pulleys 139*b* are rotated in the arrow direction (counterclockwise) in the drawing, the drive belt 139*a* also rotates in the counterclockwise direction. As a result, the base 137 and the base 138 move in the directions separating from each other (in the direction the space becomes wider). If the pulleys 139*b* are rotated in the opposite direction (clockwise), the drive belt 139*a* rotates in the clockwise direction. As a result, the base 137 and the base 138 move in the directions approaching each other (in the direction the space becomes narrower).

Figure 15:
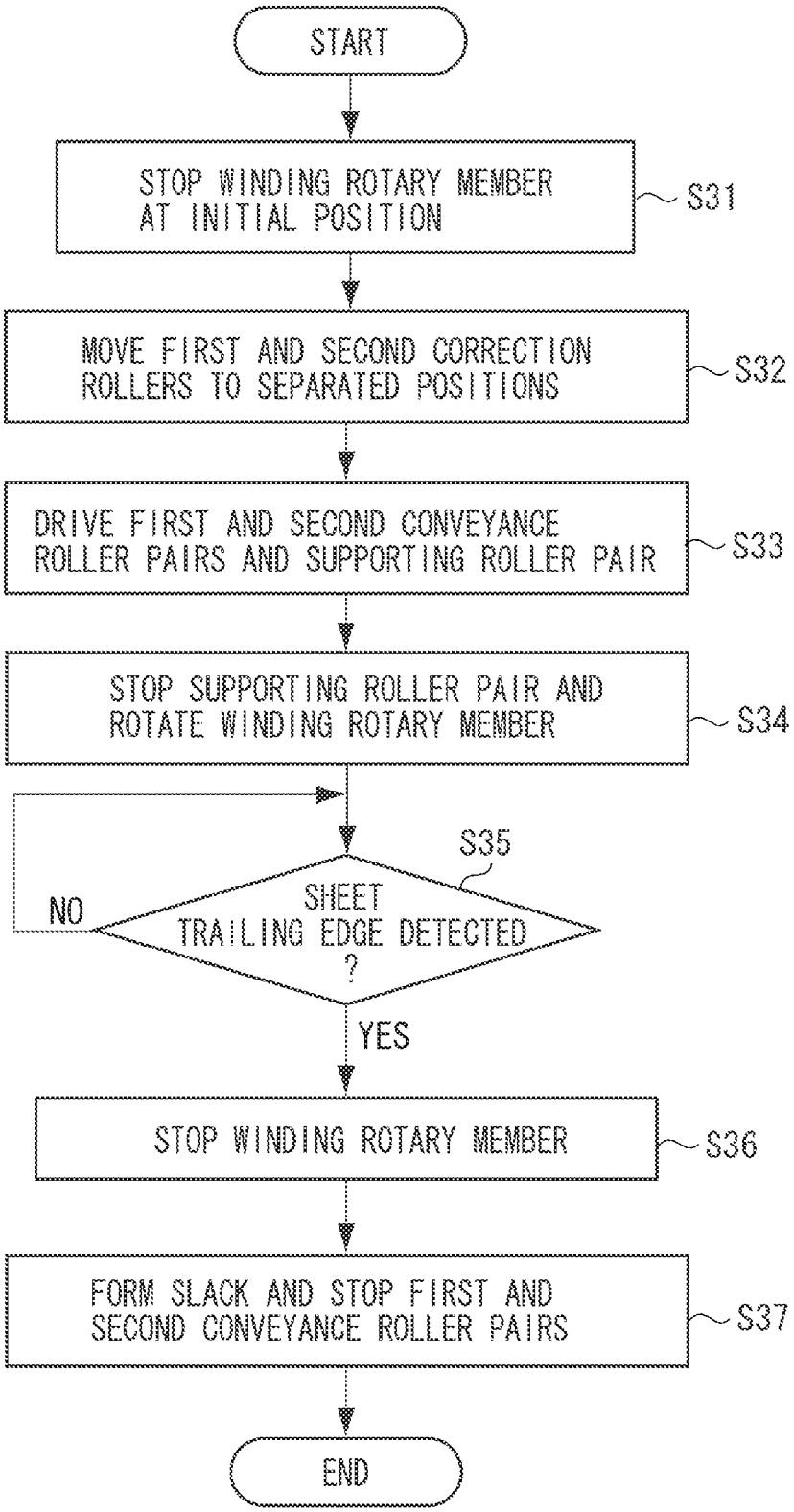
FIG. 15 is a flowchart for controlling an operation of winding the sheet around the rotary winding member.

With reference to the flowchart in FIG. 15, the operation of winding the sheet around the rotary winding member 104 while controlling the first correction roller 133 and the second correction roller 134 is described.

In step S31, the rotary winding member 104 is stopped at the initial position. In step S32, the first correction roller 133 and the second correction roller 134 are moved to positions (separated positions) such that the space between the first correction roller 133 and the second correction roller 134 is wider than the width of the sheet so as not to come in contact with the sheet, and the rotary winding member 104 stands by. In step S33, the supporting roller pair 150, the first conveyance roller pair 151, and the second conveyance roller pair 152 are driven.

In step S34, if the leading edge of the sheet passes between the first correction roller 133 and the second correction roller 134, the sheet is conveyed by the first conveyance roller pair 151, and the sheet is held by the supporting roller pair 150, the supporting roller pair 150 is stopped. Then, the sheet is wound by the rotary winding member 104. In step S35, if the trailing edge of the sheet is detected by the edge sensor 101 (YES in step S35), in step S36, the rotary winding member 104 is stopped. In step S37, the conveyance roller 102 is stopped, the sheet of the outermost periphery is caused to slack, and the winding operation ends. The conveyance roller 102 is stopped when the slack is formed and the trailing edge of the sheet passes through the second conveyance roller pair 152, and the trailing edge of the sheet is stopped between the first correction roller 133 and the second correction roller 134.

Figure 16:
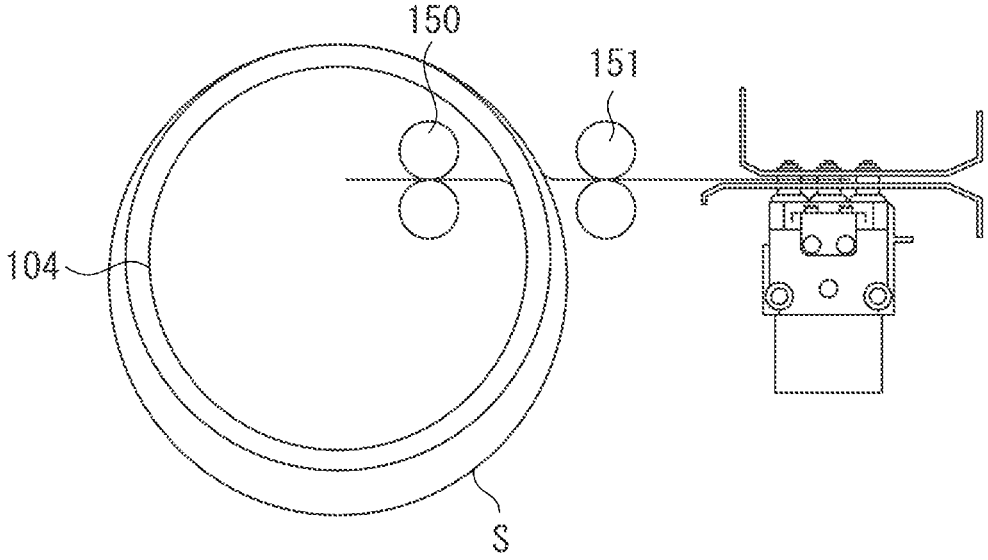
FIG. 16 illustrates a slack of the sheet formed in the rotary winding member.

FIG. 16 illustrates the state the sheet is wound around the rotary winding member 104. After the rotation of the rotary winding member is stopped, the rotation of the conveyance roller 102 on the upstream side is stopped. As a result, a loop (slack) is formed in the outermost periphery of the sheet wound around the rotary winding member 104.

Figure 17:
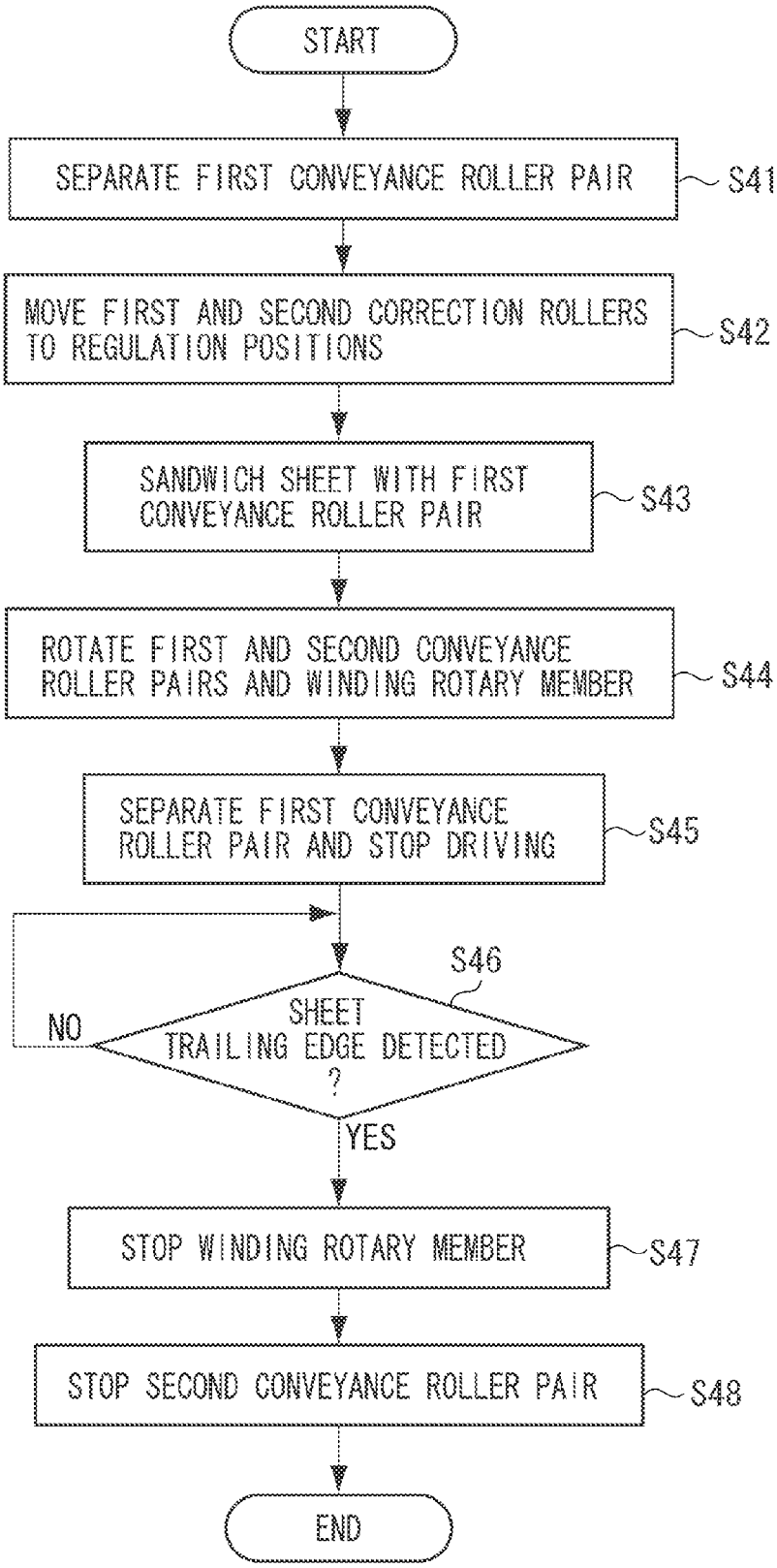
FIG. 17 is a flowchart for controlling an operation of sending out the sheet wound around the rotary winding member.

With reference to the control flowchart in FIG. 17, the operation of sending the sheet wound around the rotary winding member 104 while controlling the first correction roller 133 and the second correction roller 134 is described.

In step S41, the cam motor 173 is driven to separate the first conveyance roller pair 151. In step S42, the first correction roller 133 and the second correction roller 134 are moved to regulation positions for regulating the positions of the individual side end of the sheet to correct a skew. At the regulation positions, the space between the first correction roller 133 and the second correction roller 134 is substantially the same as the width of the sheet. After the slew is corrected, in step S43, the cam motor 173 is driven to hold the sheet with the first conveyance roller pair 151. In step S44, the first conveyance roller pair 151, the second conveyance roller pair 152, and the rotary winding member 104 are rotated in the sending direction to send out the sheet.

After the sending operation of the sheet is started, when a time period necessary for holding the leading edge of the sheet with the second conveyance roller pair 152 has passed, in step S45, the cam motor 173 is driven to separate the first conveyance roller pair 151 again. FIG. 13B illustrates the state that the skew of the sheet is corrected.

In step S46, if the trailing edge of the sheet is detected by the edge sensor 101 (YES in step S46), in step S47, the rotary winding member 104 is stopped. In step S48, after a time period necessary for the trailing edge of the sheet to pass through the second conveyance roller pair 152 has passed, the second conveyance roller pair 152 is stopped, and the sending operation ends.

When the sheet is sent, in order to keep constant the amount of the loop (slack) formed in the outermost periphery of the sheet wound around the rotary winding member 104, the speed for sending the sheet from the rotary winding member 104 is set to the same speed as the speed for conveying the sheet with the individual rollers.

The speed for sending the sheet from the rotary winding member 104 varies depending on the length of the sheet wound around the rotary winding member and the thickness of the sheet. Even if the rotary winding member 104 is rotated at the same rotation speed, if the amount of the wound sheet is large, the speed for sending the sheet increases. If the amount of the wound sheet is small, the speed for sending the sheet decreases. Consequently, when the sheet is sent from the rotary winding member, in order to maintain the loop (slack) of the constant amount formed in the outermost periphery of the sheet wound around the rotary winding member 104, the rotation speed of the rotary winding member 104 at the start of the rotation is determined depending on the length (the number of rotations) of the sheet or the type of the sheet. Further, the rotation speed of the rotary winding member 104 is changed for each predetermined number of rotations.

In order to effectively perform the skew correction, as the operation sequence, the sheet is sent out after the loop (slack) is formed in the outer periphery of the rotary winding member 104, and the first conveyance roller pair 151 is separated after the sheet is nipped with the second conveyance roller pair 152 so as to correct the skew.

The sent sheet S is positioned in the sheet width direction between the first correction roller 133 and the second correction roller 134 while the skew (orientation) of the sheet relative to the original sheet conveyance direction is corrected. In that case, since the loop of an appropriate size is always formed at the front side of the sheet S, the twist in sheet due to the skew correction is absorbed by the loop. As a result, the skew correction can be smoothly performed without excessive force applied to the sheet. Since the twist is absorbed by the loop, the sheet can be prevented from being damaged by strongly hitting the first correction roller 133 and the second correction roller 134. Consequently, the conveyance resistance can be reduced.

The the sheet is accurately positioned in the sheet width direction and the skew correction is performed, so that the sheet can be conveyed with great accuracy without skewing from the rotary winding member 104.

As described above, when the sheet is introduced, the space between the first correction roller 133 and the second correction roller 134 is set to be wider than the width of the sheet S to be used. Consequently, the sheet S does not strongly slide and contact the first correction roller 133 or the second correction roller 134. When the sheet is sent out, the space between the first correction roller 133 and the second correction roller 134 is set to the same length as the sheet width by separating the first conveyance roller pair. The control unit 13 in the printing apparatus controls the adjustment of the spaces.

In the above-described printing apparatus according to the exemplary embodiment, when the two-sided printing is performed, the first skew correction of the sheet supplied from the sheet supplying unit 1 is performed in the skew correction unit 3 before the printing unit 4. The second skew correction of the first surface of the printed sheet is performed in the cutter unit 6. In a following back-side printing operation, the third skew correction is performed on the sheet sent from the reversing unit 9. Further, the fourth skew correction is performed in the skew correction unit 3 before the printing unit 4, and the fifth skew correction is performed in the cutter unit 6.

Thus, the total of five skew corrections are performed at the three points where the positional deviation or skew in the sheet width direction is readily caused in performing the two-sided printing. As a result, a high-quality two-sided print result can be obtained. Especially, in the two-sided printing, the front-side image and the back-side image need to be precisely positioned on the front-side and the back-side of the sheet. Accordingly, the above-described five skew corrections at the important points are very effective.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-028824 filed Feb. 14, 2011, which is hereby incorporated by reference herein in its entirety.

What is claimed is:

1. A printing apparatus for winding a sheet printed on a surface of the sheet around a rotary member, sending out the sheet wound around the rotary member, and performing printing on a surface of the sheet in a printing unit, the printing apparatus comprising:

a conveying unit configured to convey the sheet to the rotary member; and a regulating unit configured to regulate a position of a side end of the sheet pulled from the rotary member, wherein the conveying unit and the rotary member are driven so that the sheet conveyed by the conveying unit is wound around the rotary member and a slack is formed in an outer periphery of the sheet wound around the rotary member, and wherein the regulating unit regulates the position of the side end of the sheet pulled from the rotary member in a state where the slack is formed around the rotary member.

2. The printing apparatus according to claim 1, wherein the conveying unit comprises:

a first conveyance roller pair capable of performing separation provided between the rotary member and the regulating unit, wherein, in a state where the first conveyance roller pair is separated, the regulating unit performs positioning on the side ends of the sheet.

3. The printing apparatus according to claim 2, wherein the regulating unit includes regulating members movable to regulation positions for regulating the positions of the side end of the sheet, and to positions separated from the side end of the sheet, if the sheet is wound around the sheet, the regulating members are moved to the separated positions, and if the sheet is sent out from the rotary member, the regulating members are moved to the regulating positions to regulate the positions of the side end of the sheet in a state where the first conveyance roller pair is separated, and after that, the sheet is sandwiched and conveyed by the first conveyance roller pair.

4. The printing apparatus according to claim 3, further comprising:

a second conveyance roller pair on a downstream from the regulating unit in a conveyance direction that the sheet is sent out from the rotary member, wherein the sheet is conveyed by the first conveyance roller pair until the sheet conveyed by the first conveyance roller pair is sandwiched by the second conveyance roller pair, and after the sheet is sandwiched by the second conveyance roller pair, the first conveyance roller pair is separated.

5. The printing apparatus according to claim 1, wherein the rotary member includes a roller pair configured to sandwich the leading edge of the sheet to hold the leading edge of the sheet to the rotary member so as to wind the sheet.

6. The printing apparatus according to claim 1, wherein a rotation speed of the rotary member is changed depending on a winding diameter.

7. The printing apparatus according to claim 1, wherein a rotation speed of the rotary member is changed depending on a type of the sheet.

8. The printing apparatus according to claim 1, wherein a rotation speed of the rotary member is determined using information in the winding operation.

9. A sheet handling apparatus for winding a sheet around a rotary member, and sending out the sheet wound around the rotary member, the sheet handling apparatus comprising:

a conveying unit configured to convey the sheet to the rotary member; and a regulating unit configured to regulate a position of a side end of the sheet sent out from the rotary member, wherein the conveying unit and the rotary member are driven so that the sheet conveyed by the conveying unit is wound around the rotary member and a slack is formed in an outer periphery of the sheet wound around the rotary member, and wherein the sheet is sent out in a state where the slack is formed in the outer periphery of the sheet wound around the rotary member, and the regulating unit guides the sheet side end sent out from the rotary member.

10. The sheet handling apparatus according to claim 9, further comprising:

a first conveyance roller pair capable of performing separation provided between the rotary member and the regulating unit, wherein, in a state where the first conveyance roller pair is separated, the regulating unit performs positioning on the side ends of the sheet.

11. The sheet handling apparatus according to claim 10, wherein the regulating unit includes regulating members movable to regulation positions for regulating the positions of the side end of the sheet, and to positions separated from the side end of the sheet, if the sheet is wound around the sheet, the regulating members are moved to the separated positions, and if the sheet is sent out, the regulating members are moved to the regulating positions to regulate the positions of the side end parts of the sheet in the state where the first conveyance roller pair is separated, and after that, the sheet is sandwiched and conveyed by the first conveyance roller pair.

12. The sheet handling apparatus according to claim 11, further comprising:

a second conveyance roller pair on the downstream side of the regulating unit in a conveyance direction that the sheet is sent out from the rotary member, wherein the sheet is conveyed by the first conveyance roller pair until the sheet conveyed by the first conveyance roller pair is sandwiched by the second conveyance roller pair, and after the sheet is sandwiched by the second conveyance roller pair, the first conveyance roller pair is separated.

13. The sheet handling apparatus according to claim 9, wherein the rotary member includes a roller pair configured to sandwich the leading edge of the sheet to hold the leading edge of the sheet to the rotary member so as to wind the sheet.

14. A printing apparatus for winding a sheet printed on a surface of the sheet around a rotary member, pulling the sheet from the rotary member, conveying the sheet to a printing position where printing is performed, and performing printing on a surface of the sheet at the printing position by a printing unit, the printing apparatus comprising a conveying unit configured to convey the sheet to wind the sheet around the rotary member and pull the sheet from the rotary member;

a rotating unit configured to rotate the rotary member to wind the sheet around the rotary member and pull the sheet from the rotary member: and a regulating unit configured to regulate a position of a side end of the sheet pulled from the rotary member, wherein the conveying unit conveys the sheet in a state where the rotary member stops for winding the sheet around the rotary member and wherein the regulating unit regulates the position of the side end of the sheet pulled from the rotary member by causing the conveying unit to convey the sheet and the rotating unit to send out the sheet at substantially same speed.

15. The printing apparatus according to claim 14, wherein the conveying unit conveys the sheet and the rotating unit sends in the sheet at substantially same speed for winding the sheet around the rotary member until the rotating unit stops rotating the rotary member.

16. The printing apparatus according to claim 15, wherein the conveying unit stops conveying the sheet for winding the sheet around the rotary member after the rotating unit stops rotating the rotary member.

* * * * *